US006349075B1

(12) United States Patent
Miyauchi et al.

(10) Patent No.: US 6,349,075 B1
(45) Date of Patent: Feb. 19, 2002

(54) ELECTRON EQUIPMENT

(75) Inventors: Norio Miyauchi, Koga; Tatsuo Nitta, Kawagoe; Tomomi Murakami, Higashimurayama, all of (JP)

(73) Assignee: Cititzen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/118,087

(22) Filed: Jul. 17, 1998

Related U.S. Application Data

(62) Division of application No. 08/877,247, filed on Jun. 17, 1997, now Pat. No. 5,878,004.

(30) Foreign Application Priority Data

Mar. 18, 1992 (JP) ..... 4-91479
Dec. 16, 1992 (JP) ..... 4-354452

(51) Int. Cl.[7] ..... G04B 19/06
(52) U.S. Cl. ..... 368/230; 256/255
(58) Field of Search ..... 368/156, 157, 368/150, 207, 268, 230, 251, 255, 72–74

(56) References Cited

U.S. PATENT DOCUMENTS 4,283,783 A * 8/1981 Nakajima et al. ..... 368/76
4,312,059 A * 1/1982 Mandai et al. ..... 368/157
4,480,218 A * 10/1984 Hair ..... 318/696
5,298,846 A * 3/1994 Shimizu et al. ..... 318/696

* cited by examiner

*Primary Examiner*—Bernard Roskoski
(74) *Attorney, Agent, or Firm*—Townsend and Townsend and Crew LLP

(57) ABSTRACT

A small electronic equipment with a vibration alarm has, as a drive source, a flat stator type bipolar stepping motor, which has a rotor having high durability, can be assembled easily, requires low power consumption, is started constantly stably, and can be rotated at a high speed. In this electronic equipment with the vibration alarm, a rotor (1) is rotated by a rotary drive system including a drive pulse generating means (112, 113, 114), a drive circuit (110), a flat stator (6), a counter electromotive voltage detection coil (306), and a magnetic pole position detection means (107, 115, 116), so that an eccentric weight (2) fixed to the rotor is rotated, thereby generating vibration. The drive pulse generating means outputs a pulse signal for driving the stepping motor on the basis of an alarm signal output at alarm time. The drive circuit supplies a drive current to a drive coil (305) on the basis of the pulse signal from the drive pulse generating means. The flat stator transmits the magnetomotive force generated in the drive coil to the rotor (1). The counter electromotive voltage detection coil detects a counter electromotive voltage generated by rotation of the rotor. The magnetic pole position detection means detects the magnetic pole position of the rotor (1), which is rotating, with respect to the flat stator (6) on the basis of the counter electromotive voltage generated in the counter electromotive voltage detection coil, and outputs, to the drive pulse generating means, a detection signal for controlling the output timing of the pulse signal supplied from the drive pulse generating means (114).

54 Claims, 33 Drawing Sheets

$\theta = 0, \pi$
--- MAGNETIC EQUILIBRIUM POINT $\theta = -\theta_o, \pi - \theta_o$
--- EXCITATION EQUILIBRIUM POINT

ELECTRON EQUIPMENT

This application is a Div of Ser. No. 08/877,247, filed Jun. 17, 1997, now U.S. Pat. No. 5,878,004.

TECHNICAL FIELD OF THE INVENTION

The present invention relates to an electronic equipment with a vibration alarm and, more particularly, to a stepping motor incorporated in an electronic equipment with a vibration alarm for alarming the user by transmitting vibration to the user's arm.

BACKGROUND ART OF THE INVENTION

As disclosed in Japanese Utility Model Laid-Open Nos. 2-6291 and 2-107089, a conventional wristwatch with a vibration alarm as an electronic equipment for generating vibration by rotating an eccentric weight by a motor incorporates an ultrasonic motor. The rotation of the rotor of the ultrasonic motor is transmitted to an eccentric weight wheel having an eccentric barycentric position. Vibration caused by the rotation of the eccentric weight wheel is transmitted to the user's arm through the watch case, thereby alarming the user by a vibration alarm.

In the ultrasonic motor of the Japanese Utility Model Laid-Open Nos. 2-6291 and 2-107089, a vibrator bonded with a piezoelectric element is supported by a support pin, and the rotor and the vibrator are brought into tight contact with each other by a compression spring. The operational principle of the ultrasonic motor is to deflect and enlarge the vibration of the piezoelectric element by a comb gear portion provided to the vibrator, to generate a traveling wave in the comb gear portion, and to rotate the rotor by a frictional compression force of the comb gear portion and the rotor.

More specifically, the rotor is rotated while it is constantly urged against the comb gear portion of the vibrator by the compression spring. Then, wear of the contact portion of the rotor and the comb gear portion is unavoidable, providing insufficient durability.

Since the vibration of the piezoelectric element has a small amplitude, the comb gear portion of the vibrator for deflecting and enlarging this amplitude requires especially high machining precision. Hence, it is difficult to machine the comb gear portion of the vibrator. In order to stably rotate the rotor, not only the vibrator but also other components, e.g., the piezoelectric element and the rotor must have high machining precision and high assembling precision.

It is an object of the present invention to provide a reliable small electronic equipment with a vibration alarm (e.g., a wristwatch), which has a rotor having high rotational durability, can be assembled easily, has low power consumption, can be stably started even if an acceleration is applied to it when, e.g., the user swings his arm, and has a stepping motor as a drive source in order to enable high-speed rotation.

SUMMARY OF THE INVENTION

In order to achieve the above object, according to the present invention, there is provided an electronic equipment with a vibration alarm, which generates vibration by rotating, with a motor, an eccentric weight having a barycenter at a position deflected from a rotary axis, characterized in that the motor is a flat stator type bipolar stepping motor which comprises a bipolar flat stator, a rotor having a bipolar permanent magnet, and a drive coil magnetically coupled to the flat stator, and in which the eccentric weight is directly fixed to a rotor shaft of the rotor, and the rotor of the flat stator type bipolar stepping motor is rotated to rotate the eccentric weight, thereby generating vibration.

In this electronic equipment with a vibration alarm, the position of the barycenter of the eccentric weight is arranged at a position satisfying $0°<\theta<90°$ or $180°<\theta<270°$ when the stator is kept still, where $\theta$ is the angle from the position of the barycenter of the eccentric weight to the vertical direction of the gravity along the rotational direction of the eccentric weight about the rotor shaft as the center.

In this electronic equipment with a vibration alarm, the eccentric weight and the rotor magnet are fixed to the rotor shaft such that $\alpha$ and $\beta$ are substantially equal angles where $\beta$ is the angle from the barycenter of the eccentric weight to a magnetic pole of the rotor magnet along the rotational direction of the eccentric weight about the rotor shaft as the center and $\alpha$ is the angle between a slit of the stator of the flat stator type bipolar stepping motor and the vertical direction of the gravity.

This electronic equipment with a vibration alarm is a wristwatch, and the eccentric weight and the rotor magnet are fixed to the rotor shaft such that $\alpha$ and $\beta$ are substantially equal angles where $\alpha$ is the angle between a slit of the stator of the flat stator type bipolar stepping motor and the direction of 12 o'clock from the center of the dial of the watch.

This electronic equipment with a vibration alarm is a wristwatch and comprises a main plate constituting a timepiece module and a dial having marks. The eccentric weight is arranged on the dial side with the main plate as a boundary. The rotor magnet is arranged on a side opposite to the dial.

This electronic equipment with a vibration alarm is a wristwatch and comprises a main plate constituting a timepiece module and a dial having marks. The eccentric weight is arranged to be adjacent to the main plate. Through holes for exposing part of the eccentric weight are formed in the main plate and the dial.

In this electronic equipment with a vibration alarm, a rotary drive circuit device of the rotor of the flat stator type bipolar stepping motor comprises drive pulse generating means for outputting a pulse signal for driving the stepping motor on the basis of an alarm signal output at alarm time, a drive circuit for supplying a drive current to the drive coil on the basis of the pulse signal supplied from the drive pulse generating means, the flat stator for transmitting a magnetomotive force generated in the drive coil to the rotor, a counter electromotive voltage detection coil for detecting a counter electromotive voltage generated by rotation of the rotor, and magnetic pole position detection means for detecting a magnetic pole position of the rotor, which is rotating, with respect to the flat stator on the basis of the counter electromotive voltage generated in the counter electromotive voltage detection coil, and outputting, to the drive pulse generating means, a detection signal for controlling an output timing of the pulse signal from the drive pulse generating means.

As is apparent from the above aspects, in the electronic equipment of the present invention, a flat stator type bipolar stepping motor which is established in the prior art is utilized. An eccentric weight is directly fixed to the rotor shaft of a rotor constituting the flat stator type bipolar stepping motor. The eccentric weight is rotated by rotating the rotor, so that vibration accompanying rotation of the barycenter of the eccentric weight is generated. Then, the user is alarmed with the vibration.

As described above, according to the present invention, an electronic equipment with a vibration alarm can be constituted by using a flat stator type bipolar stepping motor that can make free use of the prior art providing advanced machining techniques. The eccentric weight is directly fixed to the rotor shaft. The eccentric weight is rotated by rotating the rotor of the flat stator type bipolar stepping motor, thereby generating vibration. Hence, a reliable electronic equipment with a vibration alarm having a rotor of high rotational durability, which can be easily assembled, requires low power consumption, and can be stably rotated, can be provided.

According to the present invention, the position of the barycenter of the eccentric weight is arranged to satisfy $0°<\theta<90°$ or $180°<\theta<270°$ when the stator is kept still, where $\theta$ is the angle from the position of the barycenter of the eccentric weight to the vertical direction of the gravity along the rotational direction of the eccentric weight about the rotor shaft as the center. Therefore, a reliable electronic equipment with a vibration alarm that can be stably started and rotated even when an acceleration is applied to it by, e.g., the swing of the arm, can be provided.

According to the present invention, the eccentric weight and the rotor magnet are fixed to the rotor shaft such that $\alpha$ and $\beta$ are substantially equal angles where $\beta$ is the angle from the barycenter of the eccentric weight to a magnetic pole of the rotor magnet along the rotational direction of the eccentric weight about the rotor shaft as the center and $\alpha$ is the angle between a slit of the stator of the flat stator type bipolar stepping motor and the vertical direction of the gravity. Therefore, an electronic equipment with a vibration alarm that can be started readily even when an acceleration and a gravitational acceleration caused by the swing of the arm are simultaneously applied to it can be provided.

According to the present invention, an electronic equipment with a vibration alarm that can be started readily even when an acceleration and a gravitational acceleration caused by the swing of the arm are simultaneously applied to it can be provided only by measuring the angle $\alpha$ between the slit of the stator and the vertical direction of the gravity in advance, providing a mark in advance to part of the eccentric weight at an angle $\beta$ from the barycenter of the eccentric weight along a rotational direction C, and fixing the rotor magnet to the rotor shaft by aligning the mark indicating the direction of the magnetic pole of the rotor magnet with the mark of the eccentric weight.

According to the present invention, the worst state wherein the starting operation of the electronic equipment with a vibration alarm is adversely affected the worst is set when the user jogs with the electronic equipment with the vibration alarm on his arm. In this case, the direction of 12 o'clock of the dial of the watch substantially coincides with the vertical direction of the gravitational acceleration. Therefore, an electronic equipment with a vibration alarm that can be started readily even when an acceleration and a gravitational acceleration caused by the swing of the arm are simultaneously applied to it can be provided by fixing the eccentric weight and the rotor magnet to the rotor shaft such that $\alpha$ and $\beta$ are substantially equal angles where $\alpha$ is the angle between a slit of the stator of the flat stator type bipolar stepping motor and the direction of 12 o'clock from the center of the dial of the watch.

According to the present invention, with reference to the main plate constituting a timepiece module as a boundary, when the eccentric weight is arranged on the dial side and the rotor magnet is arranged on a side opposite to the dial, the module thickness in the periphery of the flat stator type bipolar stepping motor excluding a coil block can be suppressed and flat batteries can be stacked, thereby constituting a low-profile timepiece module.

According to the present invention, the eccentric weight is arranged to be adjacent to the main plate constituting a timepiece module, and through holes for exposing part of the eccentric weight are formed in the main plate and the dial. Therefore, rotation of the eccentric weight can be visually informed to the user other than the vibration accompanying rotation of the barycenter of the eccentric weight.

Furthermore, according to the present invention, there is provided a reliable small electronic equipment with a vibration alarm, having a stepping motor that requires a small power consumption, has a high durability, can be assembled easily, and can be stably started and rotated at a high speed. Especially, this electronic equipment with a vibration alarm has a magnetic pole position detection means for detecting the magnetic pole position of the rotating rotor with respect to the flat stator on the basis of a counter electromotive voltage generated in the counter electromotive voltage detection coil. The drive pulse generating means controls the output timing of the pulse signal on the basis of a detection signal from the magnetic pole position detection means. Therefore, a high-speed stepping motor necessary for the vibration alarm can be realized.

The above and other objects, aspects, and advantages of the present invention will become apparent to those skilled in the art from the following detailed description of the preferred embodiments thereof based on the principle of the present invention with reference to the accompanying drawings.

BEST MODE OF CARRYING OUT THE INVENTION

Figure 1:
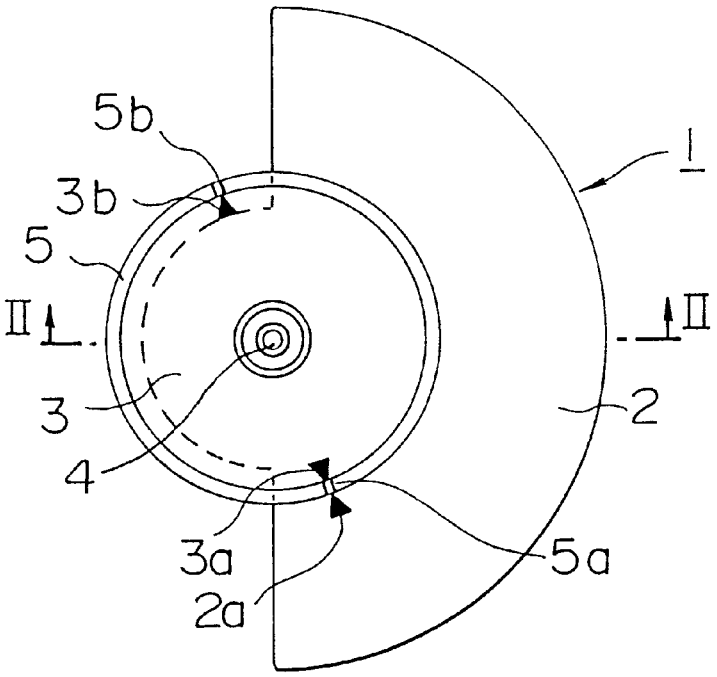
FIG. 1 is a plan view of a rotor constituting a flat stator type bipolar stepping motor of an electronic equipment with a vibration alarm according to the present invention.
Figure 2:
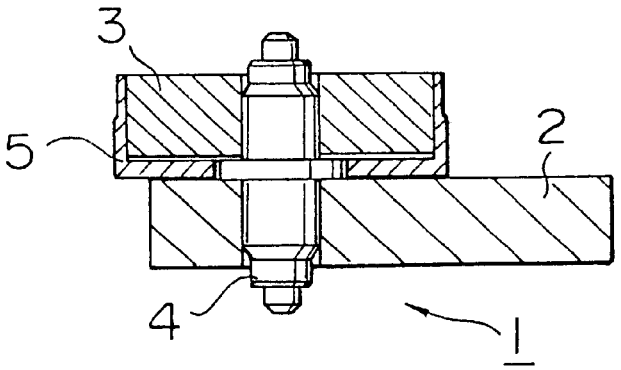
FIG. 2 is a sectional view taken along the line II—II of FIG. 1.

Several preferred embodiments of the present invention will be described with reference to the accompanying drawings. FIG. 1 is a plan view of a rotor driven by a flat stator type bipolar stepping motor of an electronic equipment with a vibration alarm according to the present invention, and FIG. 2 is a sectional view taken along the line II—II of FIG. 1.

Reference numeral 3 denotes a rotor magnet; 4, a rotor shaft; 5, a rotor magnet frame; and 2, an eccentric weight having the barycenter at a position deflected from the rotor shaft 4 as its rotary shaft. The eccentric weight 2, the rotor magnet 3, the rotor shaft 4, and the rotor magnet frame 5 constitute a rotor 1. Reference numeral 2*a* denotes a printed mark provided to the eccentric weight 2; 3*a*, a printed mark provided to the rotor magnet 3; and 5*a*, a notched mark provided to the rotor magnet frame 5.

The assembly procedure of the rotor 1 will be described as follows. The eccentric weight 2 is directly fixed to the rotor shaft 4. Then, the rotor magnet 3 is fixed to the rotor magnet frame 5 such that the marks 3*a* and 5*a* substantially coincide with each other. Finally, the rotor magnet frame 5 is fixed to the rotor shaft 4 such that the marks 5*a* and 2*b* substantially coincide with each other, thereby completing the rotor 1.

Figure 3:
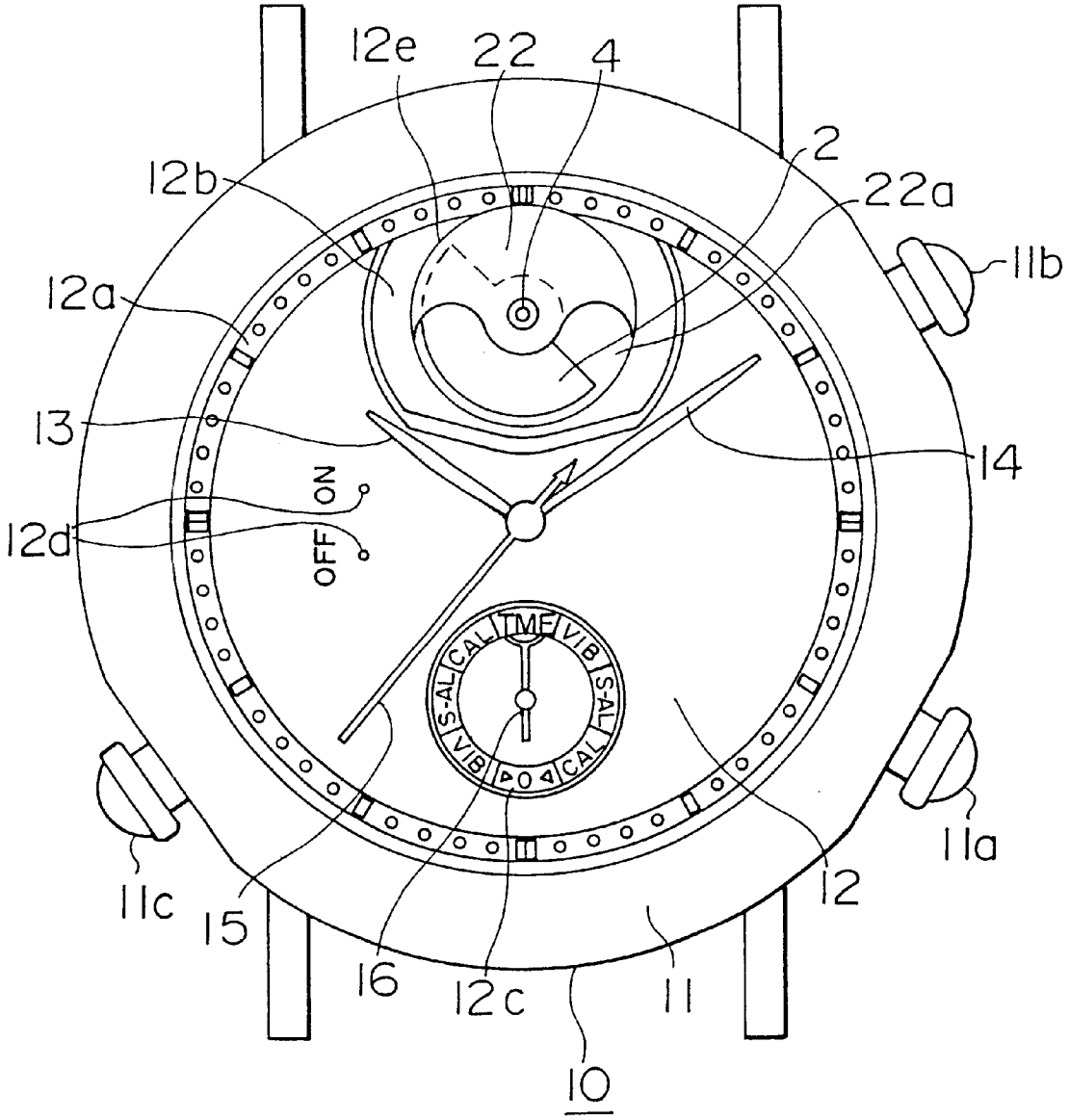
FIG. 3 is a plan view of a case wherein the electronic equipment having the vibration alarm according to the present invention is a wristwatch.
Figure 4:
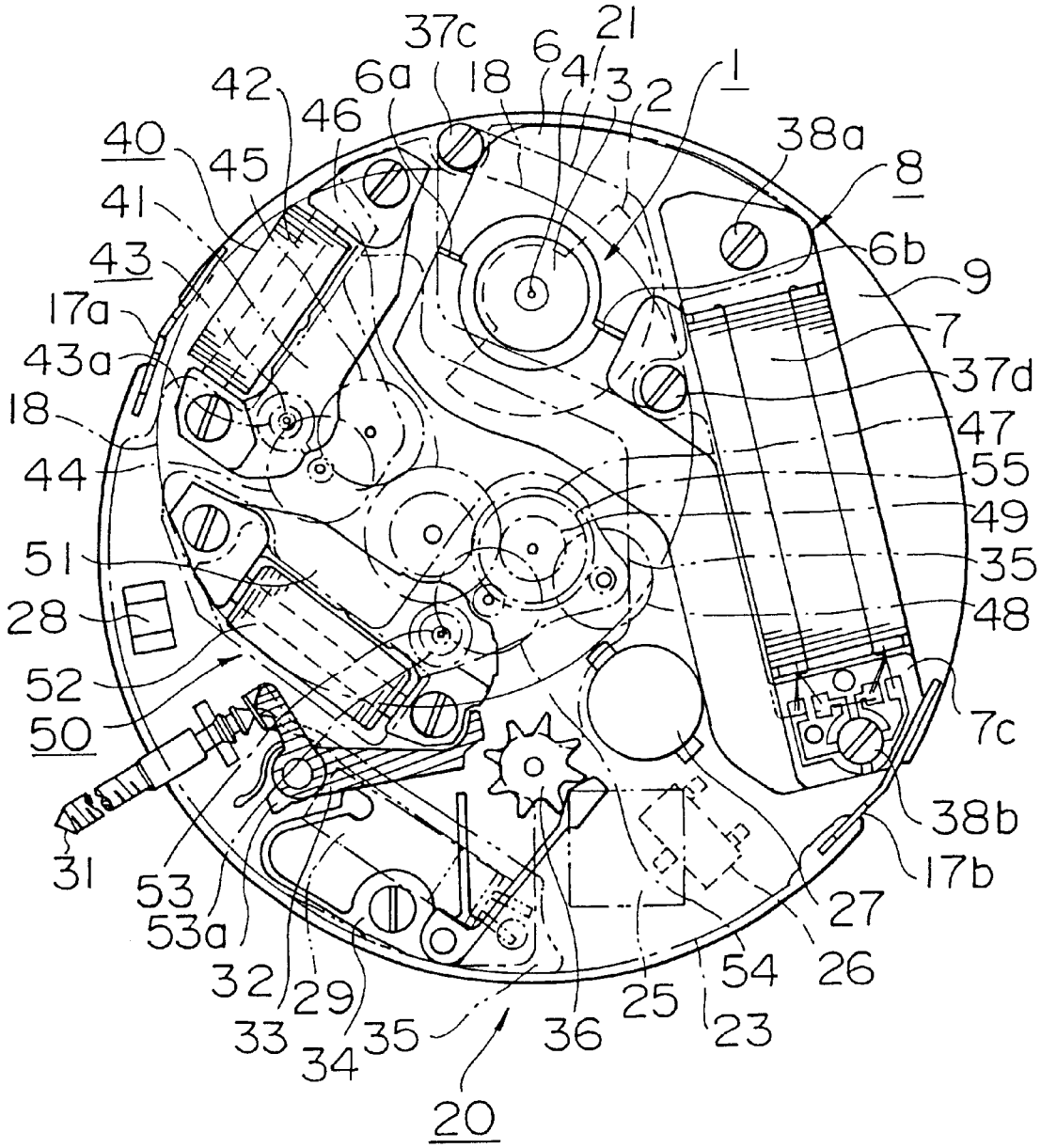
FIG. 4 is a plan view showing the module of the wristwatch shown in FIG. 3.
Figure 5:
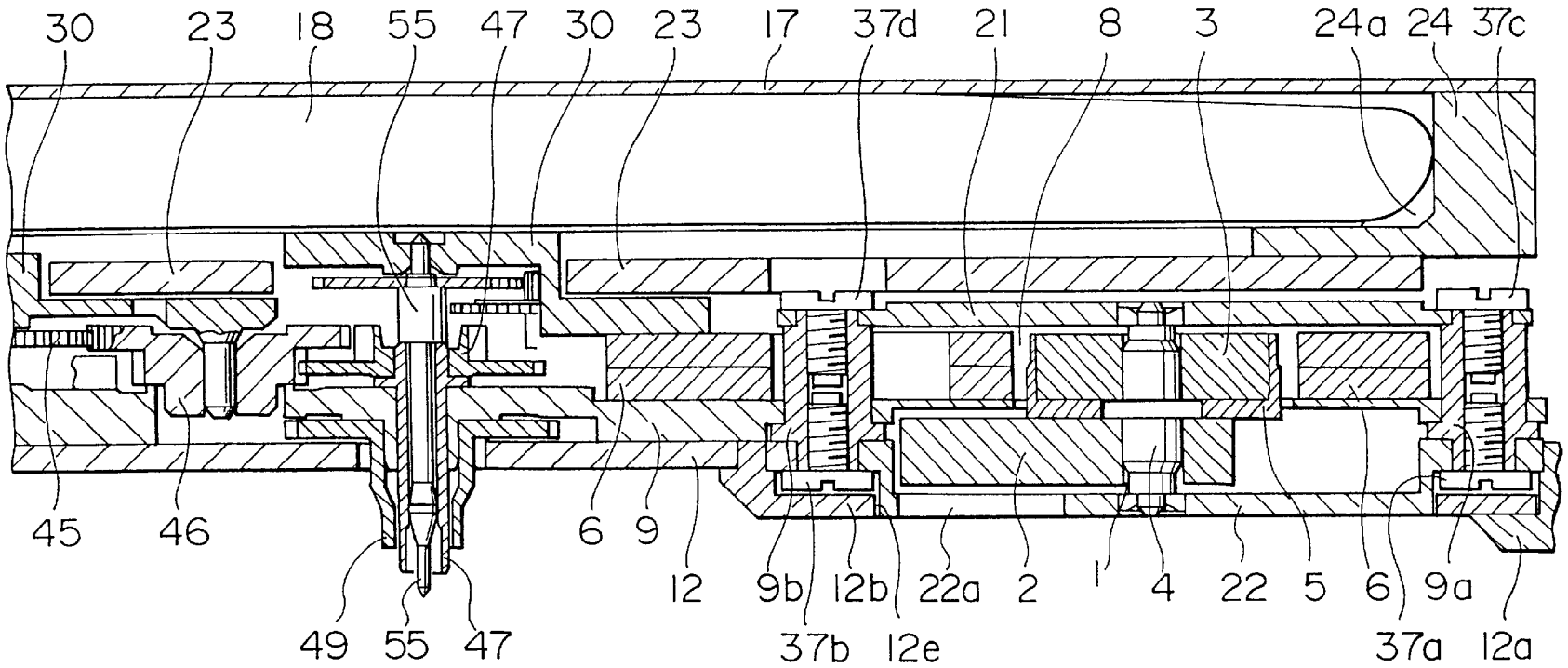
FIG. 5 is a sectional view of the module of the wristwatch shown in FIG. 4.
Figure 6:
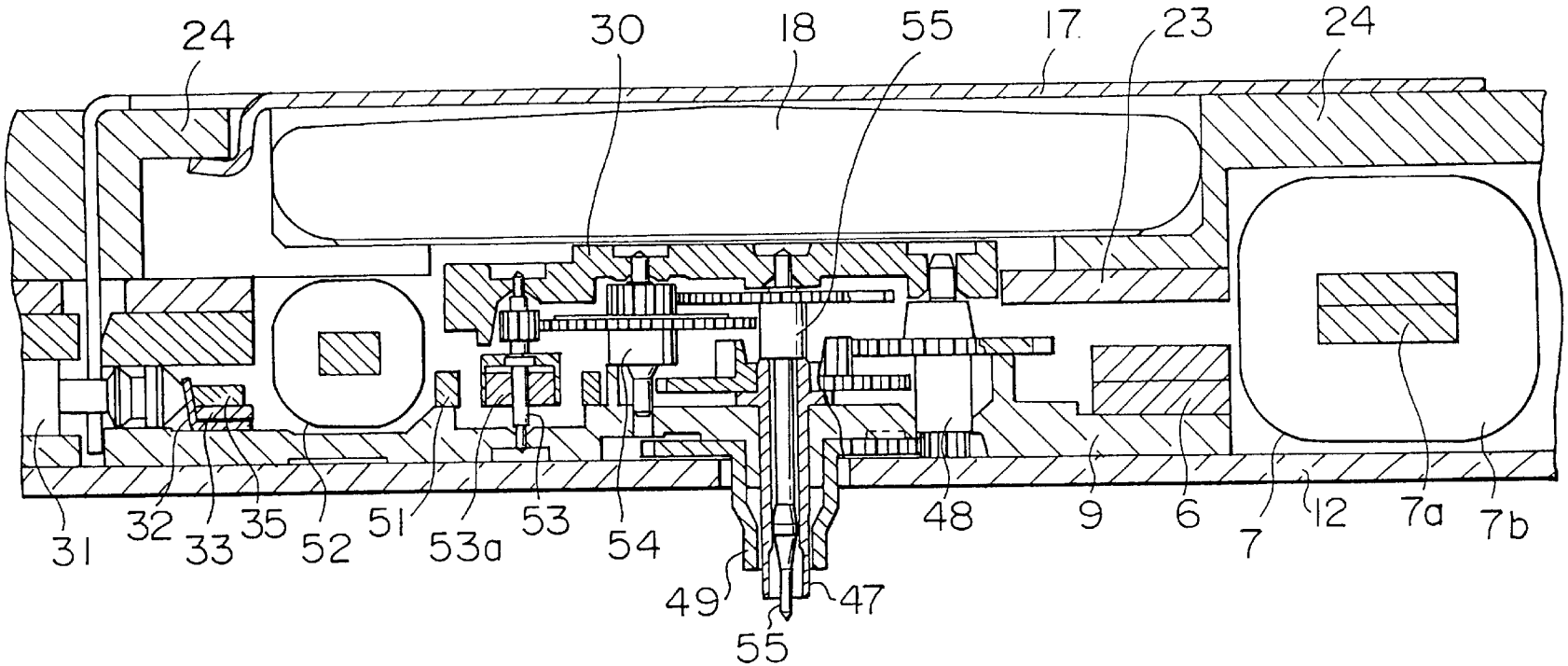
FIG. 6 is a sectional view of the module of the wristwatch shown in FIG. 4.

An embodiment of the electronic equipment with the vibration alarm which uses the rotor 1 will be described with reference to FIGS. 3 to 6. FIG. 3 is a plan view of an embodiment wherein the electronic equipment with the vibration alarm according to the present invention is a wristwatch, FIG. 4 is a plan view showing the module of the wristwatch shown in FIG. 3, and FIGS. 5 and 6 are sectional views of the module of the wristwatch shown in FIG. 4. Note that the same elements in the drawings are denoted by the same reference numerals throughout the drawings, and a detailed description thereof will be omitted.

Reference numeral 11 denotes a housing of the wristwatch; 11*a*, a mode designation button screwed to a switch winding stem 31; and 11*b* and 11*c*, operation buttons built in the housing 11 of the wristwatch. The switch winding stem 31 is interlocked with a switch spring 32, a mode change lever 33, a mode control lever 34, a switch winding stem return spring 35, and a mode wheel 36. When the button 11*a* is depressed once, the mode wheel 36 is rotated by an amount corresponding to one tooth.

Reference numeral 12 denotes a dial of the watch. The dial 12 has marks 12*a*. A mode mark 12*c* and alarm ON/OFF marks 12*d* are printed on the dial 12. Reference numeral 13 denotes an hour hand; 14, a minute hand; 15, a second hand; and 16, a mode hand. FIG. 3 shows a state wherein the mode hand indicates a time mode, and the hour hand 13, the minute hand 14, and the second hand 15 indicate time. In FIGS. 5 and 6, the sections of the hour hand 13, the minute hand 14, and the second hand 15 are omitted and not shown.

The hour hand 13, the minute hand 14, the second hand 15, and the mode hand 16 are pushed into a hour wheel 49, a center wheel 47, a second wheel 55, and the mode wheel 36, respectively. When the button 11*a* is depressed once, the mode wheel 36 is rotated by an amount corresponding to one tooth, and the mode hand 16 pushed into the mode wheel 36 indicates a subsequent mode. The hour hand 13 and the minute hand 14 indicate the alarm time, the calendar date, and the like in accordance with the modes. The second hand 15 indicates whether the alarm is ON or OFF.

Reference numeral 12*b* denotes a panel cover provided to the dial 12. The panel cover 12*b* conceals bridge screws 37*a* and 37*b* of a lower bridge 22, and a through hole 12*e* for exposing part of the eccentric weight 2 is formed in the panel cover 12*b*. Reference numeral 22*a* denotes a through hole formed in the lower bridge 22. The through hole 22*a* is provided to expose part of the eccentric weight 2 in the same manner as in the panel cover 12*b*. As a result, in the electronic equipment 10 with the vibration alarm of this embodiment, part of the eccentric weight 2 can be seen from part of the dial 12 when the electronic equipment 10 is a completed wristwatch.

Reference numeral 6 denotes a stator; and 7, a coil block 7. The stator 6 and the coil block 7 constitute a flat stator type bipolar stepping motor 8 together with a rotor 1. In the flat stator type bipolar stepping motor 8 of this embodiment, a slit type stator having slits 6*a* and 6*b* is used as the stator 6. The stator 6 and a coil core 7*a* having larger sizes (thicknesses of about twice) than that of the flat stator type bipolar stepping motor of the watch are employed for the purpose of maintaining the drive torque of the eccentric weight 2 and preventing saturation of the magnetic flux of the magnetic circuit. Especially, in this embodiment, to facilitate pressing of the thick stator 6 and the thick coil core 7*a*, two overlapping stators 6 and two overlapping coil cores 7*a* are used. A thick single stator 6 and a thick single coil core 7*a* formed by pressing may be used instead, as a matter of course.

Reference numeral 9 denotes a main plate constituting a timepiece module 20; reference numerals 9*a* and 9*b* denote tubes pushed into the main plate 9; and reference numeral 21 denotes an upper bridge. The tubes 9*a* and 9*b* guide the upper and lower bridges 21 and 22, and the upper and lower bridges 21 and 22 serve as the bearing of the rotor shaft 4 of the rotor 1.

In this embodiment, the upper and lower bridges 21 and 22 serve as the bearing of the rotor shaft 4 of the rotor 1. However, the upper bridge 21 and the main plate 9 may serve as the bearing of the rotor shaft 4 of the rotor 1, and the eccentric weight 2 may be fixed to part of the rotor shaft 4 exposed from the main plate 9.

In the rotor 1, with respect to the main plate 9 as the boundary, the eccentric weight 2 is arranged on the dial 12 side and the rotor magnet 3 is arranged on the opposite side of the dial 12. The rotor 1 can be rotated about the rotor shaft 4 as the center so that part of the eccentric weight 2 can be seen through the through hole 22*a* formed in the lower bridge 22.

Reference numeral 41 denotes a stator; 42, a coil block; and 43, a rotor. Reference numeral 43*a* denotes a rotor magnet. The stator 41, the coil block 42, and the rotor 43 constitute a flat stator type bipolar stepping motor 40 for driving the hour hand 13 and the minute hand 14.

Reference numerals 44, 45, and 46 denote wheels constituting the wheel train for decelerating rotation of the rotor 43 of the flat stator type bipolar stepping motor 40. The wheels 44, 45, and 46 mesh with the center wheel 47 to drive the minute hand 14. Reference numeral 48 denotes a minute wheel. The minute wheel 48 meshes with the center wheel 47 and the hour wheel 49 to drive the hour hand 13.

Reference numeral 51 denotes a stator 52, a coil block; and 53, a rotor. Reference numeral 53*a* denotes a rotor magnet. The stator 51, the coil block 52, and the rotor 53 constitute the flat stator type bipolar stepping motor 50 for driving the second hand 15.

Reference numeral 54 denotes a wheel for decelerating rotation of the rotor 53 of the flat stator type bipolar stepping motor 50. The wheel 54 meshes with the second wheel 55 to drive the second hand 15. Note that the tenons of the wheels of the wheel train driven by the flat stator type bipolar stepping motors 40 and 50 are held by the main plate 9 and a train wheel bridge 30.

Reference numeral 23 denotes a circuit board. An IC 25, a transistor 26, a booster coil 27, a chip resistor 28, a crystal oscillator 29, and the like are mounted on the circuit board 23 to drive the three flat stator type bipolar stepping motors 8, 40, and 50. Although not shown, a flexible printed circuit board is electrically connected to the upper surdial of the circuit board 23 by thermal bonding. When this flexible printed circuit board (not shown) and a coil lead terminal 7*c* of the coil block 7 of the flat stator type bipolar stepping motor 8 are laid and fixed by a screw 38*b*, the circuit board 23 and the coil lead terminal 7*c* of the coil block 7 are electrically connected to each other.

Reference numeral 24 denotes a circuit support; 18, a flat battery; and 17, a battery clamp spring. The circuit support 24 is laid on the circuit board 23. The flat battery 18 is placed on a battery storing portion 24*a* which does not sectionally overlap the coil block 7 of the circuit support 24. A power is supplied from the flat battery 18 to the circuit board 23 through the battery clamp spring 17 and a battery rest spring (not shown). Reference numerals 17*a* and 17*b* denote switch springs interlocked with the buttons 11*b* and 11*c*. The switch springs 17*a* and 17*b* are formed by utilizing part of the battery clamp spring 17 and used as the switch input means of the circuit board 23. The timepiece module 20 is constituted in this manner.

As described above, in this embodiment, with respect to the main plate 9 constituting the timepiece module 20 as the boundary, the eccentric weight 2 is arranged on the dial 12 side and the rotor magnet 3 is arranged in the opposite side of the dial 12. Accordingly, the module thickness in the periphery of the flat stator type bipolar stepping motor 8 excluding the coil block 7 is small in spite that the stepping motor 8 has a size larger than that of the stepping motor 40 or 50, and that the thick stator 6 and the thick coil core 7*a*, that are larger than those of the flat stator type bipolar stepping motor 40 or 50 for the watch (almost twice) are employed. Then, the flat battery 18 can be laid on the periphery of the flat stator type bipolar stepping motor 8 such that the coil block 7 and the flat battery 18 do not sectionally overlap, thereby constituting a flat timepiece module.

The operation of the vibration alarm of the timepiece module 20 will be described. In the state of FIG. 3, when the button 11*a* is depressed once or five times, the mode wheel 36 is rotated for an amount corresponding to one tooth or five teeth in the interlocked manner to the switch winding stem 31, and the mode hand 16 indicates the vibration alarm mode.

The vibration alarm mode is switched when the IC 25 determines that the mode switch change spring (not shown) interlocked to the mode wheel 36 and the pattern of the circuit board 23 contact each other. The IC 25 sends a drive signal to the flat stator type bipolar stepping motor 40 to fast-forward the hour hand 13 and the minute hand 14 to the alarm time. Simultaneously, the IC 25 sends a drive signal to the flat stator type bipolar stepping motor 50 to fast-forward the second hand 15 to the alarm ON/OFF marks 12*d* printed on the dial 12. If the vibration alarm is in the OFF state, the second hand 15 is stopped at the position of the OFF mark; if it is in the ON state, the second hand 15 is stopped at the ON mark.

In this state, every time the button 11*b* is depressed, the ON/OFF state of the vibration alarm is switched, and the second hand 15 is fast-forwarded to reciprocate between the positions of the ON/OFF marks 12*d* indicating the current state. If the button 11*a* is pulled in this state, the setting operation of the time of the vibration alarm is enabled. If the button 11*b* is depressed, the hour hand 13 and the minute hand 14 can be moved clockwise; if the button 11*c* is depressed, the hour hand 13 and the minute hand 14 can be moved counterclockwise. The time of the vibration alarm is set using the two buttons 11*b* and 11*c*. After the time of the vibration alarm is set, the button 11*a* is depressed to end the setting operation of the time of the vibration alarm.

While the vibration alarm is in the ON state, when the alarm time is reached, a drive signal is sent to the coil block 7 of the flat stator type bipolar stepping motor 8 to rotate the rotor 1 at a high speed. More specifically, since the eccentric weight 2 is rotated, vibration accompanying rotation of the barycenter of the eccentric weight 2 is generated and informed to the user in the form of a vibration of the housing 11 of the watch.

When the power consumption at this time was measured, the peak current at 6,000 rpm obtained when the vibration alarm was driven under the optimal driving conditions was 2 mA at the power supply voltage of 3 V. It was confirmed that this vibration alarm could be driven with a power consumption of 5% or less that necessary for a vibration alarm using an ultrasonic motor.

The operation of the sound alarm of the timepiece module 20 will be described. In the state of FIG. 3, when the button 11*a* is depressed twice or six times, the mode wheel 36 is rotated by an amount corresponding to two or six teeth in a manner interlocked to the switch winding stem 31, and the mode hand 16 indicates the sound alarm mode.

The sound alarm mode is switched when the IC 25 determines that the mode switch change spring (not shown) interlocked to the mode wheel 36 and the pattern of the circuit board 23 contact each other, in the same manner as in the switching operation of the vibration alarm mode. The IC 25 sends a drive signal to the flat stator type bipolar stepping motor 40 to fast-forward the hour hand 13 and the minute hand 14 to the alarm time. Simultaneously, the IC 25 sends a drive signal to the flat stator type bipolar stepping motor 50 to fast-forward the second hand 15 to the ON/OFF marks 12*d* printed on the dial 12. At this time, if the sound alarm is in the OFF state, the second hand 15 is stopped at the OFF mark; if it is in the ON state, the second hand 15 is stopped at the ON mark.

In this state, every time the operation button 11*b* is depressed, the ON/OFF state of the sound alarm is switched, and the second hand 15 is fast-forwarded to reciprocate between the positions of the alarm ON/OFF marks 12*d* indicating the current state. If the button 11*a* is pulled in this state, the setting operation of the time of the sound alarm is enabled. Then, if the button 11*b* is depressed, the hour hand 13 and the minute hand 14 can be moved clockwise; if the button 11*c* is depressed, the hour hand 13 and the minute hand 14 can be moved counterclockwise. The sound alarm time is set by using the two buttons 11*b* and 11*c*. After the sound alarm time is set, the button 11*a* is depressed to end the setting the sound alarm time.

While the sound alarm is in the ON state, when the alarm time is reached, a drive signal is sent to the booster coil 27 through the transistor 26 to excite the piezoelectric element (not shown) adhered to the back of the wristwatch, thereby bendably vibrating the back. Then, an alarm can be informed in the form of a sound.

Regarding the rotor 1 of this embodiment, in order to inform the user of the alarm by utilizing vibration accompanying rotation of the barycenter of the eccentric weight 2, the rotor 1 having the heavy eccentric weight 2 must inevitably be used, and not the rotors of the flat stator type bipolar stepping motors 40 and 50 that are conventionally used in a watch. The influence of the gravity must be especially considered when starting the rotor 1.

Figure 7:
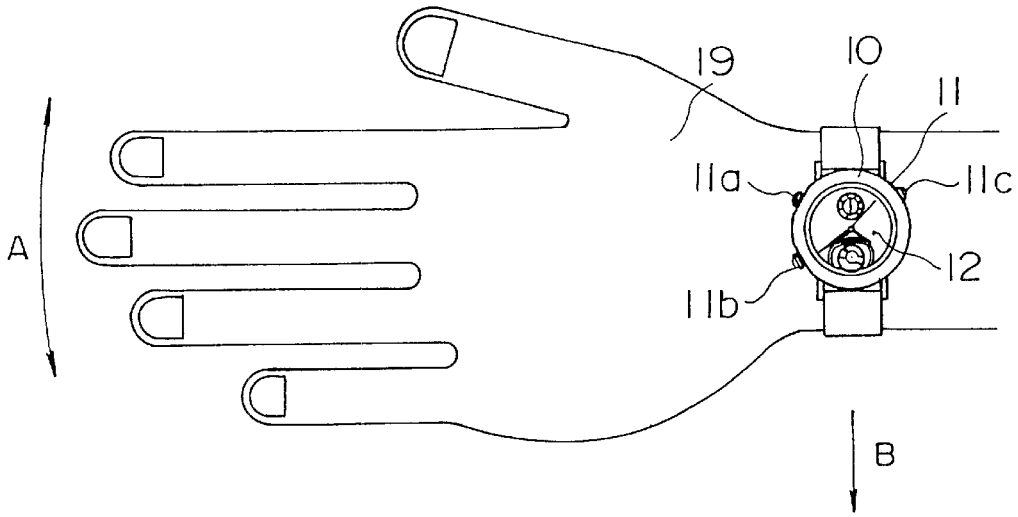
FIG. 7 is a view showing the outer appearance representing the relationship between the electronic equipment with the vibration alarm according to the present invention and an arm.
Figure 8:
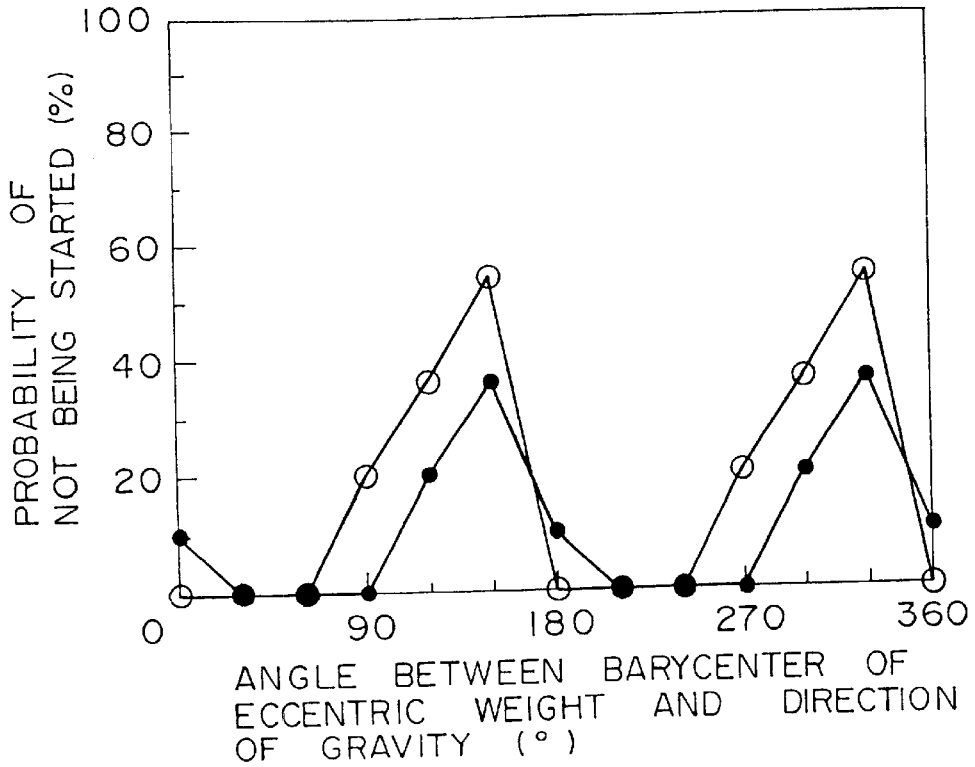
FIG. 8 is a graph showing the relationship between an angle, defined by the stationary position of the barycenter of the eccentric weight and the vertical direction of the gravity, and the starting performance of a rotor of the present invention.

FIG. 7 is a view showing an outer appearance representing the relationship between the electronic equipment 10 with the vibration alarm according to the present invention and an arm in an experiment conducted in order to examine the influence of the gravity, FIG. 8 is a graph showing the relationship between an angle, defined by the stationary position of the barycenter of the eccentric weight 2 and the vertical direction of the gravity, and the starting performance of the rotor 1 of the present invention, which relationship showing the influence of the gravity, and FIG. 9 shows diagrams respectively showing the relationship between the rotational direction of the rotor 1 and the stationary position of the barycenter of the eccentric weight 2 of the present invention.

In this embodiment, the electronic equipment 10 with the vibration alarm is a wristwatch which is used mainly by being put on the arm, and takes various types of postures when it is carried. In normal carrying, however, the gravity does not substantially adversely affect the starting operation of the flat stator type bipolar stepping motor 8. As far as the user is in a normal life, the gravity does not adversely affect much the starting operation of the motor. In FIG. 7, the starting operation of the electronic equipment 10 with the vibration alarm according to the present invention is adversely affected the worst when the user jogs with the electronic equipment 10 with the vibration alarm on his arm 19. It is confirmed that the acceleration caused when the user swings his arm 19 in this state is about 3 Hz and about 1.3 G. When the relationship between the acceleration and the gravitational acceleration caused by swinging the arm 19 was examined, it was confirmed that the starting performance was degraded the worst when a swing direction A of the arm 19 and a vertical direction B of the gravitational acceleration substantially coincided with each other.

As shown in FIG. 9, an angle from a barycentric position 2*b* of the eccentric weight 2 in the stationary state of the rotor 1 to the vertical direction B of the gravitational acceleration along rotational directions C and D of the eccentric weight 2 about the rotor shaft 4 as the center was defined as θ, and the probability of the rotors not being started was experimentally obtained by changing θ. The result as shown in FIG. 8 was obtained.

From FIG. 8, it was confirmed that the angle providing the lowest probability of not being started, i.e., the angle θ capable of starting the rotor 1 easily satisfied $0°<\theta<90°$ or $180°<\theta<270°$. Especially, it was confirmed that the rotor 1 was assuredly started when θ was about 45° or 225° (=45°+180°).

Figure 9A:
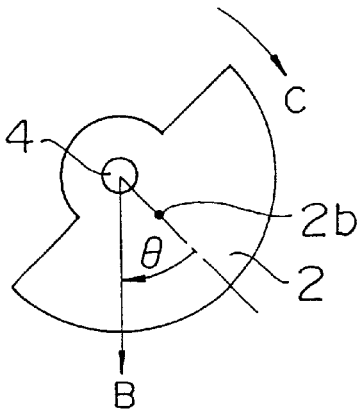
FIGS. 9A to 9D are diagrams respectively showing the relationship between the rotational direction of the rotor and the stationary position of the barycenter of the eccentric weight of the present invention.
Figure 9C:
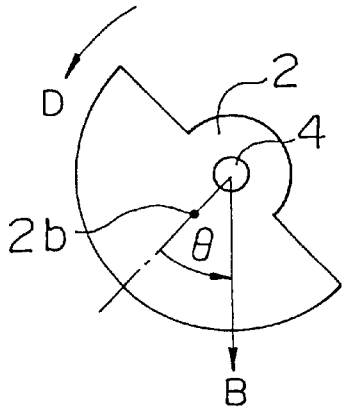
Figure 9B:
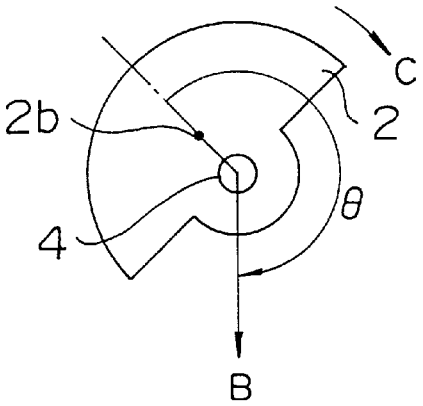
Figure 9D:
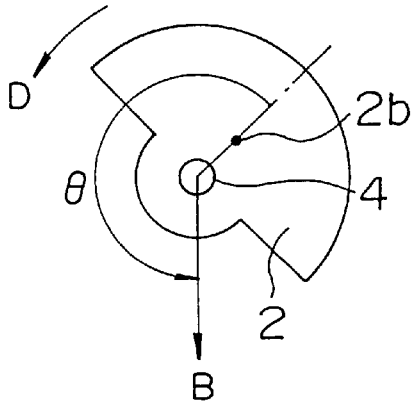

FIGS. 9A to 9D show states in which the rotor 1 is easily started. The rotational direction in of the combination of FIGS. 9A and 9B is C, and the rotational direction in the combination of FIGS. 9C and 9D is D, i.e., they are opposite. The relationship between FIGS. 9A and 9B, and the relationship between FIGS. 9C and 9D are determined by the characteristics of the flat stator type bipolar stepping motor. This is because the rotor 1 has two stationary stable points, caused by the holding torque, at positions separated from each other by 180°. Every time a drive pulse is input, the eccentric weight 2 is moved from the position of FIG. 9A to the position of FIG. 9B and from the position of FIG. 9B to the position of FIG. 9A.

A state in which the rotor 1 is easily started will be described with reference to FIG. 9A. When the rotational direction of the eccentric weight 2 is C (i.e., $0°<\theta<90°$), as the gravity of the eccentric weight 2 serves as a moment in the same direction as the rotational direction before starting, the rotor 1 can be started easily. Similarly, in FIG. 9B, when the rotational direction of the eccentric weight 2 is C (i.e., $180°<\theta<270°$), the gravity of the eccentric weight 2 serves as a moment in the opposite direction to the rotational direction before starting. However, when the eccentric weight 2 is moved to the position satisfying $\theta\leqq180°$ by a drive pulse, in the subsequent rotation, the gravity of the eccentric weight 2 serves as a moment in the same direction as the rotational direction. Therefore, the rotor 1 can be started.

Inversely, a state in which the rotor 1 is difficult to start will be described with reference to FIG. 9A. When the rotational direction of the eccentric weight 2 is D (i.e., the opposite direction to the rotational direction C and satisfying $270°\leqq\theta\leqq360°$), the gravity of the eccentric weight 2 serves as a moment in the opposite direction to the rotational direction before starting. In this state, the eccentric weight 2 must be rotated through 90° to 180° by a drive pulse, which is equivalent rotation by a half revolution, in order to be moved to the position satisfying $\theta\leqq180°$. Otherwise, the gravity does not serve as a moment in the same direction as the rotational direction. Therefore, the rotor 1 is difficult to start.

Similarly, in FIG. 9B, when the rotational direction of the eccentric weight 2 is D (i.e., in the opposite rotation to the rotational direction C and satisfying $90°\leqq\theta\leqq180°$), the gravity of the eccentric weight 2 serves as a moment in the same direction as the rotational direction before starting, and the rotor 1 is started by the first pulse. However, when the second pulse is received, the eccentric weight 2 is reversed by 180°, and the rotational direction of the eccentric weight 2 becomes the direction D, which is completely the same as in FIG. 9A. Then, the gravity does not serve as a moment in the same direction as the rotational direction unless the eccentric weight 2 is moved to the position satisfying $\theta\leqq180°$. Therefore, the rotor 1 is difficult to start.

Figure 10:
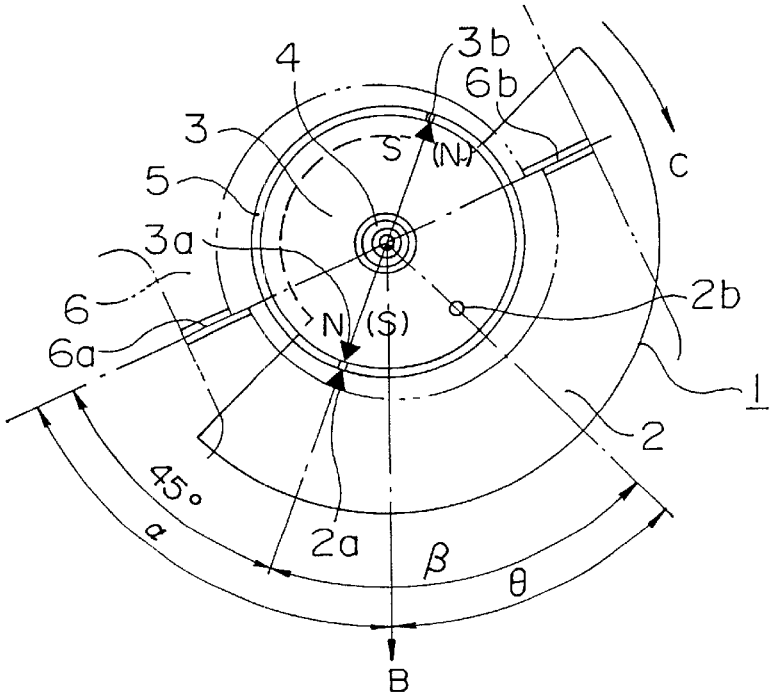
FIG. 10 is a plan view showing the relationship between the slit angle of the stator and the angle of the eccentric weight built into the rotor shaft of a flat stator type bipolar stepping motor of the present invention.

FIG. 10 is a plan view showing the relationship between the slit angle of a stator 6 and the angle of an eccentric weight 2 built into a rotor shaft 4 when a slit type motor is used as a flat stator type bipolar stepping motor of the present invention.

As in FIG. 2, reference numeral 2*a* denotes a printed mark provided to the eccentric weight 2, and reference numerals 3*a* and 3*b* denote printed marks provided to a rotor magnet 3. Especially, the printed marks 3*a* and 3*b* indicate the directions of the magnetic poles of the rotor magnet 3. Reference symbol a denotes an angle between a slit 6*a* of the stator 6 and a vertical direction B of the gravity; and β, an angle from a barycentric position 2*b* of the eccentric weight 2 to the magnetic pole 3*a* of the rotor magnet 3 along a rotational direction C of the eccentric weight 2 about the rotor shaft 4 as the center.

Generally, the stationary stable point of a rotor 1 of a flat stator type bipolar stepping motor having a slit caused by the holding torque is almost 45° with respect to the slit 6*a*, as shown in FIG. 10. Therefore, a relation as in the following equation (1) is established between α and β:

$$\alpha+\theta\approx\beta+45° \tag{1}$$

The angle with which the rotor 1 is reliably started is $\theta\approx45°$ as described above. A substitution of $\theta\approx45°$ in equation (1) yields equation (2):

$$\alpha\approx\beta \tag{2}$$

More specifically, it suffices if the eccentric weight 2 and the rotor magnet 3 are fixed to the rotor shaft 4 such that α and β become substantially equal to each other. Accordingly, if the angle α between the slit 6*a* of the stator 6 and the vertical direction B of the gravity is measured, the printed mark 2*a* is provided on part of the eccentric weight 2 at the angle β from the barycenter 2*b* of the eccentric weight 2 along the rotational direction C, and the eccentric weight 2 and the rotor magnet 3 are fixed to the rotor shaft 4 by aligning the printed mark 3*a* indicating the direction of the magnetic pole of the rotor magnet 3 and the printed mark 2*a* of the eccentric weight 2, then an electronic equipment 10 with a vibration alarm can be constituted, which can be started easily even when the acceleration and gravitational acceleration caused by the swing of an arm 19 simultaneously act on it.

The mark 2*a* is not limited to a printed mark but can be an engraved mark or projection. The electronic equipment 10 with the vibration alarm that can be easily started even when the acceleration and the gravitational acceleration caused by the swing of the arm 19 simultaneously act on it can be constituted only by marking the mark 2*a* at a position at the angle β of part of the eccentric weight 2 by printing, engraving, or the like, such that the angle of the mark 2*a* is equal to the angle α defined by the slit 6*a* of the stator 6 and the vertical direction B of the gravity, and building the eccentric weight 2 into the rotor shaft such that the mark 2*a* is aligned with the mark 3*a* of the rotor magnet 3.

Figure 11:
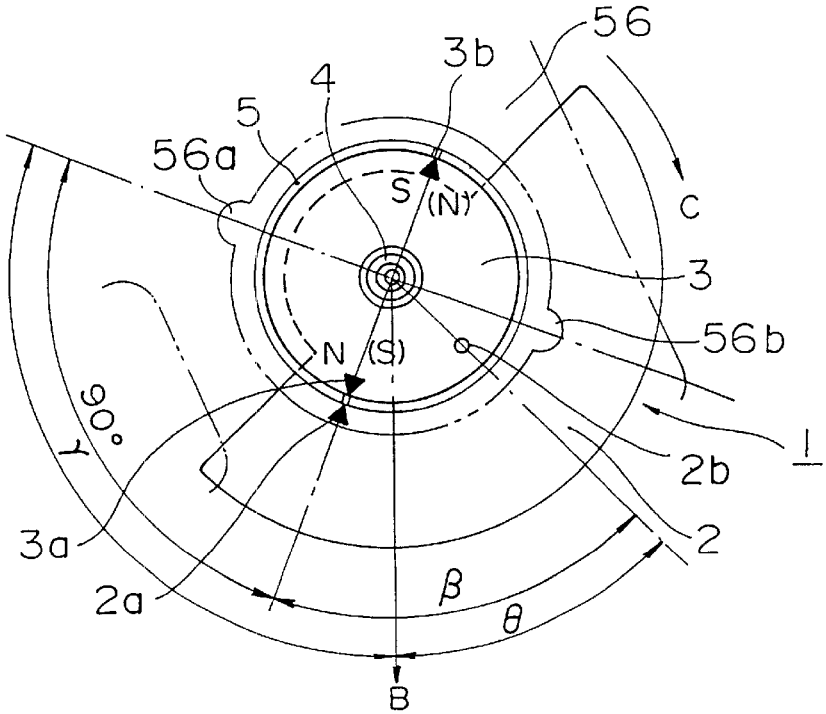
FIG. 11 is a plan view showing the relationship between the notch angle of the stator and the angle of the eccentric weight built into the rotor shaft of a flat stator type bipolar stepping motor of the present invention.

FIG. 11 is a plan view showing the relationship between the notch angle of a stator 56 and the angle of an eccentric weight built into a rotor shaft when a notch type motor shown in Japanese Patent Publication No. 59-17613 is used as the flat stator type bipolar stepping motor of the present invention. Note that reference symbol γ is the angle between a notch 56*a* of the stator 56 and a vertical direction B of the gravity.

Generally, as shown in FIG. 11, the stationary stable point of the rotor 1 of a flat stator type bipolar stepping motor having a notch caused by the holding torque is almost 90° with respect to the notch 56*a*, as in Japanese Patent Publication No. 59-17613. Therefore, a relation as in the following equation (3) is established between $\gamma$ and $\beta$:

$$\gamma+\theta\approx\beta+90^\circ \quad (3)$$

The angle with which the rotor 1 is reliably started is $\theta\approx45^\circ$ as described above. A substitution of $\theta\approx45^\circ$ in equation (3) yields equation (4):

$$\gamma\approx\beta+45^\circ \quad (4)$$

More specifically, it suffices if an eccentric weight 2 and a rotor magnet 3 are fixed to a rotor shaft 4 such that $(\gamma-45^\circ)$ and $\beta$ become substantially equal to each other. Accordingly, if the angle $\gamma$ between the notch 56*a* of the stator 56 and a vertical direction B of the gravity is measured, a printed mark 2*a* is provided on part of the eccentric weight 2 at the angle $\beta$ $(=\pi-45^\circ)$ from a barycenter 2*b* of the eccentric weight 2 along the rotational direction C, and the eccentric weight 2 and the rotor magnet 3 are fixed to the rotor shaft 4 by aligning the printed mark 3*a* indicating the direction of the magnetic pole of the rotor magnet 3 and the printed mark 2*a* of the eccentric weight 2, then an electronic equipment 10 with a vibration alarm can be constituted, which can be started easily even when the acceleration and gravitational acceleration caused by the swing of an arm 19 simultaneously act on it.

As described above with reference to FIG. 7, the starting operation of the electronic equipment 10 with the vibration alarm according to the present invention is adversely affected the worst when the user jogs with the electronic equipment 10 with the vibration alarm on his arm 19. At this time, as shown in FIG. 7, the direction of 12 o'clock of the dial 12 of the watch 10 with respect to the arm 19 substantially coincides with the vertical direction of the gravitational acceleration.

Accordingly, when the eccentric weight 2 and the rotor magnet 3 are fixed to the rotor shaft 4 such that $\alpha$ and $\beta$ substantially coincide with each other where $\alpha$ is the angle between the slit 6*a* of the stator 6 of the flat stator type bipolar stepping motor 8 and the direction of 12 o'clock from the center of the dial 12 of the watch 10, the electronic equipment 10 with the vibration alarm which can be started easily even when the acceleration and gravitational acceleration caused by the swing of the arm 19 simultaneously act on it can be constituted.

Figure 12:
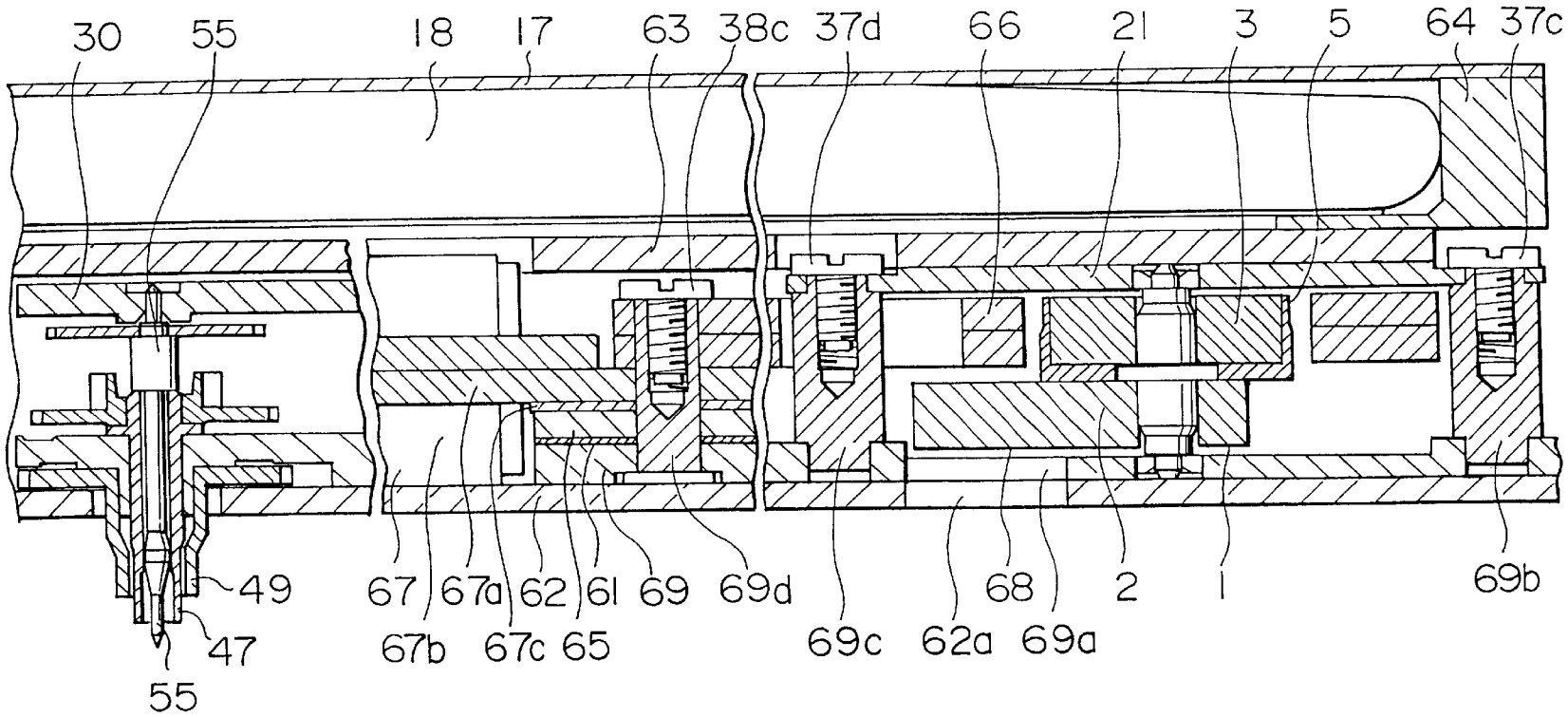
FIG. 12 is a sectional view of the module of a wristwatch as another embodiment of the present invention wherein the electronic equipment with the vibration alarm is a wristwatch.
Figure 13:
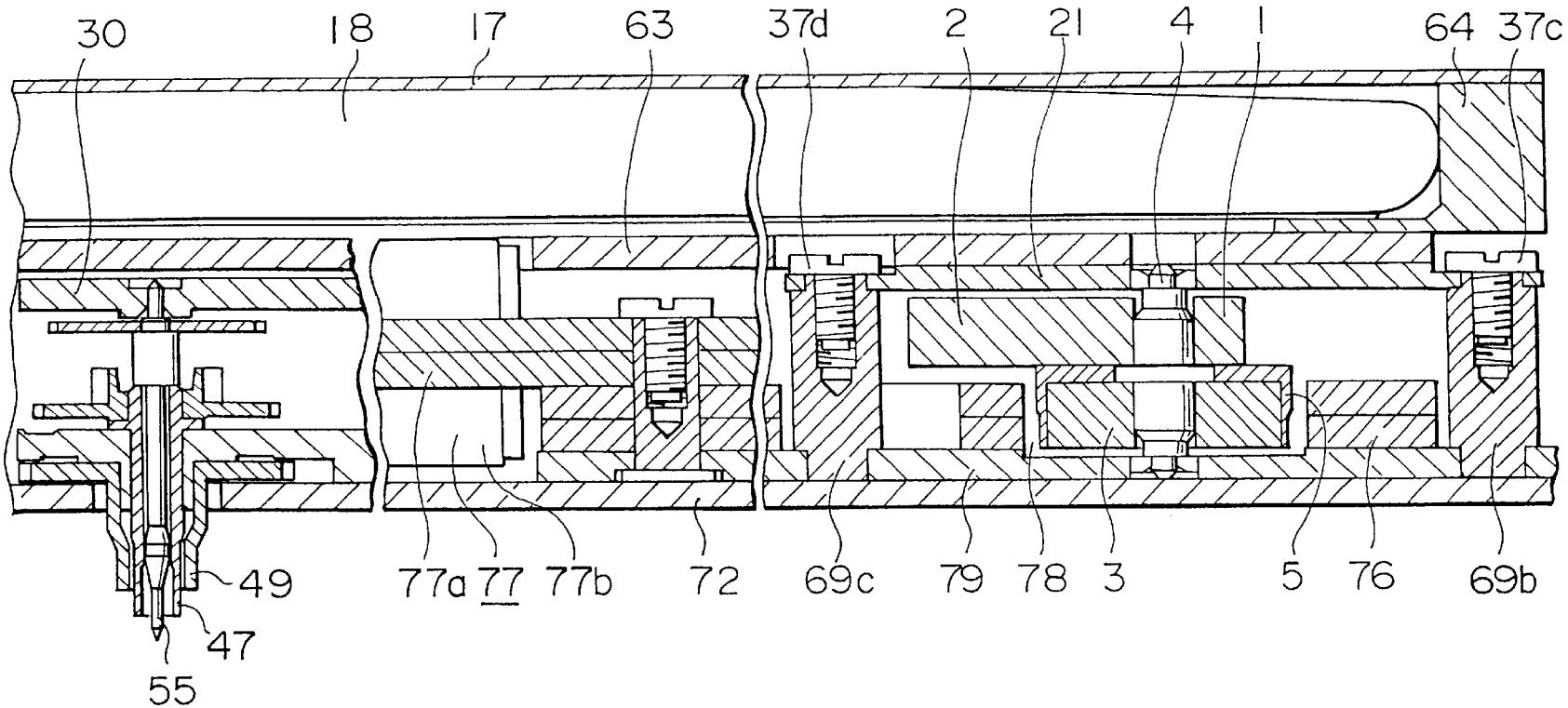
FIG. 13 is a sectional view of the module of a wristwatch as still another embodiment of the present invention wherein the electronic equipment with the vibration alarm is a wristwatch.

When the eccentric weight 2 and the rotor magnet 3 are fixed to the rotor shaft 4 such that $\beta$ and $(\gamma-45^\circ)$ substantially coincide with each other where $\gamma$ is the angle from the notch 56*a* of the stator 56 of the flat stator type bipolar stepping motor having a notch to the direction of 12 o'clock from the center of the dial 12 of the watch 10, the electronic equipment 10 with the vibration alarm which can be started easily even when the acceleration and gravitational acceleration caused by the swing of the arm 19 simultaneously act on it can be constituted with the notch type motor in the same manner. An electronic equipment with a vibration alarm according to another embodiment which uses a rotor 1 identical to that described above will be described. FIG. 12 is a sectional view of the module of a wristwatch as an embodiment when the electronic equipment with the vibration alarm of the present invention is a wristwatch, and FIG. 13 is a sectional view of the module of a wristwatch according to still another embodiment. Reference numerals 62 and 72 denote dials of watches each having marks (not shown); and 69 and 79, main plates each constituting a timepiece module. Reference numerals 69*b* and 69*c* denote tubes pushed into each of the main plates 69 and 79. The tubes 69*b* and 69*c* guide each upper bridge 21, and the upper bridge 21 and the main plate 69 or 79 serve as the bearing of a rotor shaft 4 of a rotor 1.

Reference numeral 62*a* denotes a through hole formed in the dial 62; and 69*a*, a through hole formed in the main plate 69. The through holes 62*a* and 69*a* are provided to expose part of an eccentric weight 2. In the embodiment of FIG. 12, when an eccentric weight 2 of a rotor 1 is arranged to be adjacent to the main plate 69, part of the eccentric weight 2 can be seen from part of the dial 62 of a completed wristwatch. Inversely, in FIG. 13, part of an eccentric weight 2 is not exposed.

Reference numerals 66 and 76 denote stators; and 67 and 77, coil blocks. The coil blocks 67 and 77 constitute flat stator type bipolar stepping motors 68 and 78 together with rotors 1. In this embodiment, in the same manner as in the embodiment of FIG. 4, the stators 66 and 76 and coil cores 67*a* and 77*a* each having a large size (a thickness of about twice that of a conventional one) are employed for the purpose of maintaining the drive torque of the eccentric weight 2 and preventing saturation of the magnetic flux of the magnetic circuit. Especially, in this embodiment, in order to facilitate pressing of the thick stators 66 and 76 and the thick coil cores 67*a* and 77*a*, two overlapping stators 66 and 76, and two overlapping coil cores 67*a* and 77*a* are used. Thick single stators 66 and 76 and thick single coil cores 67*a* and 76*a* formed by pressing may be used instead, as a matter of course.

Reference numeral 63 denotes a circuit board. An IC, a transistor, a booster coil, a chip resistor, and the like (not shown) are mounted on each circuit board 63 to drive the corresponding flat stator type bipolar stepping motor 68 or 78. Reference numeral 61 denotes an insulating sheet; and 65, a second circuit board. The second circuit board 65 and a coil lead terminal 67*c* of the coil block 67 are electrically connected to each other by fixing using a screw 38*c*. Although not shown, the circuit board 63 and the second circuit board 65 are electrically connected to each other through a flexible printed circuit board, so that the coil lead terminal 67*c* of the coil block 67 of the flat stator type bipolar stepping motor 68 and the circuit board 63 are electrically connected to each other.

A coil lead terminal (not shown) of the coil block 77 of the flat stator type bipolar stepping motor 78 and the circuit board 63 are electrically connected to each other by a conventional method of laying the coil lead terminal and the circuit board 63, which method is employed in the flat stator type bipolar stepping motors 40 and 50.

Reference numeral 64 denotes a circuit support. The circuit support 64 is laid on the circuit board 63, and a flat battery 18 is placed on the circuit support 64. A power is supplied from the flat battery 18 to the circuit board 63 through a battery clamp spring 17 and a battery rest spring (not shown).

The operation of the vibration alarm having the arrangement as described above is similar to that of the timepiece module 20 of FIG. 4. While the vibration alarm is in the ON state, when the alarm time is reached, a drive signal is sent to the coil block 67 or 77 of the flat stator type bipolar stepping motor 68 or 78 to rotate the rotor 1 at a high speed. More specifically, as the eccentric weight 2 is rotated, vibration accompanying rotation of the barycenter 2*b* of the eccentric weight 2 is generated, and an alarm is informed to the user in the form of a vibration of a housing 11 of the wristwatch.

In this embodiment, the electronic equipment having the vibration alarm is a wristwatch. However, it is apparent that the present invention can be applied to a small electronic equipment, e.g., a card type pocket bell with a vibration alarm.

The stepping motor for the vibration alarm according to the present invention will be described in more detail with reference the accompanying drawings from FIG. 14.

As is apparent from the above description referring to FIG. 4, the stepping motor for the vibration alarm of the present invention can be arranged between the watch case and the wristwatch module without forming an unused space. The high-speed driving system of the flat stator type bipolar stepping motor for reliably transmitting vibration to the arm will be described.

In the following description, the flat stator type bipolar stepping motor will merely be referred to as a stepping motor.

Figure 16A:
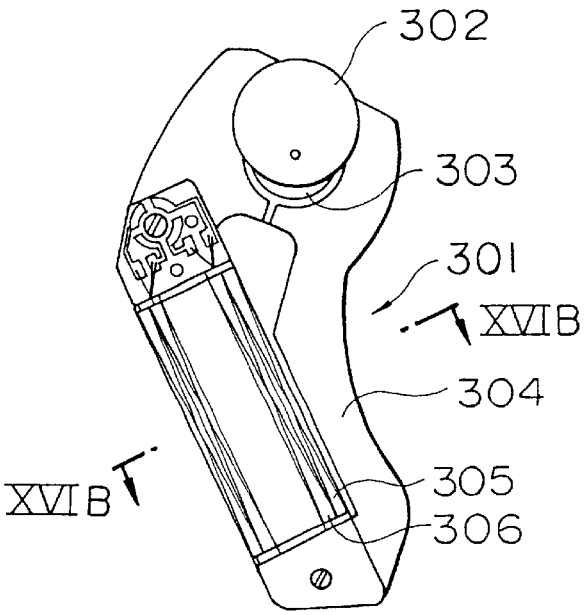
FIG. 16A is a plan view of the stepping motor having the separation type coils for driving a vibration alarm.
Figure 16B:
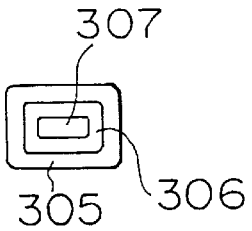
FIG. 16B is a sectional view taken along the line XVIB—XVIB of FIG. 16A.
Figure 16C:
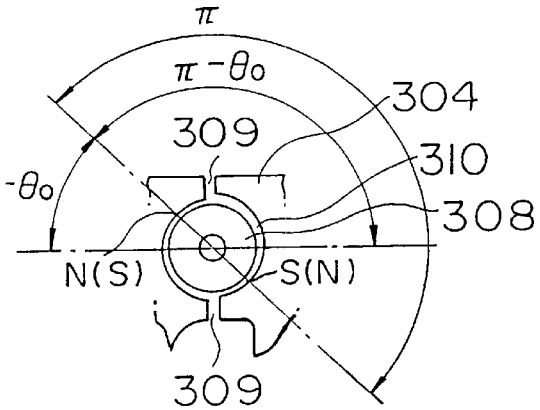
FIG. 16C is a plan view of the assembly of a stator and a rotor.

A high-speed rotor driving method of the present invention for increasing the frequency per minute of the rotor of separation type coils 305 and 306 will be described. FIG. 16A is a plan view of a stepping motor for driving a vibration alarm in separation type coils, FIG. 16B is a sectional view taken along the line XVIB—XVIB of FIG. 16A, and FIG. 16C is a plan view of a stator and a rotor. A stepping motor 301 is constituted by a rotor 303 having an eccentric weight 302, a stator 304, a drive coil 305, and a counter electromotive voltage detection coil 306. The single counter electromotive voltage detection coil 306 is separated from the drive coil 305. As shown in FIG. 16B, the counter electromotive voltage detection coil 306 is wound on a coil core 307 inside the drive coil 305.

The counter electromotive voltage generated in the counter electromotive voltage detection coil will be explained.

A current ia flowing in the counter electromotive voltage detection coil can be set to zero by a counter electromotive voltage Va generated by the counter electromotive voltage detection coil described above. Hence, when a voltage drop Ra·ia caused by a drive coil DC resistance Ra of the counter electromotive voltage detection coil and a counter electromotive voltage −La·(dia/dt) (where La is the self-inductance of the counter electromotive voltage detection coil 306) caused by the change in the current ia over time are ignored, the counter electromotive voltage Va generated in the counter electromotive voltage detection coil can be obtained in accordance with the following equation (5):

$$Va=-M\cdot(di/dt)-Ka\cdot\sin(\theta+\theta_0)\cdot(d\theta/dt) \quad (5)$$

In equation (5), −M·(di/dt) is obtained by inverting the sign of the product of a transinductance M (the transinductance M is expressed as M=k·na0·na/Rm where na0 and na are the numbers of turns of the drive coil 305 and the counter electromotive voltage detection coil 306, respectively, k is the constant of proportionality, and Rm is the magnetic resistance of the magnetic circuit of the stepping motor) of the counter electromotive voltage detection coil 306 and the drive coil 305, and the change in a drive current i over time (which also means the current obtained when the drive pulse is turned off). −M·(di/dt) is generated when the drive current i changes over time. $-Ka\cdot\sin(\theta+\theta_0)\cdot(d\theta/dt)$ is obtained by inverting the sign of the product of a mechanical coupling coefficient Ka with respect to the stepping motor 301, $\sin(\theta+\theta_0)$, and the change in a rotational angle θ over time, i.e., the angular velocity of the rotor 303. $-Ka\cdot\sin(\theta+\theta_0)\cdot(d\theta/dt)$ is generated when the rotor 303 is rotated. $\theta_0$ is the initial angle of the rotor 303. In the plan view of FIG. 16C showing the stator and the rotor, $\theta_0$ is the angle from the position of the magnetic pole N (S) of a rotor magnet 308 of the rotor 303, which is set still by the detent torque, to the position of almost 90° from a slit 309 of the stator 304.

An output Vga of a differential amplifier (to be described later) can be obtained in accordance with the following equation (6):

$$Vga=-Ga\cdot M\cdot(di/dt)-Ga\cdot Ka\cdot\sin(\theta+\theta_0)\cdot(d\theta/dt) \quad (6)$$

Vga of equation (6) is a differential amplifier output F of a differential amplifier 108 in the block diagram of the high-speed drive circuit shown in FIG. 14 (to be described later) for the rotor of the stepping motor. By detecting a time point when $-Ga\cdot Ka\cdot\sin(\theta+\theta_0)\cdot(d\theta/dt)=0$, the rotational angle $\theta(-\theta_0, -\theta_0+\pi)$, shown in FIG. 16C, of the rotor 303 from the position of the magnetic pole N (S) of the rotor magnet 308 of the rotor 303 which is set still by the detent torque can be detected. Note that Ga represents the gain (including the sign hereinafter) of the differential amplifier 108. −Ga·M·(di/dt) of equation (6) can be neglected and does not influence detection.

The arrangement of an embodiment of the high-speed drive circuit shown in the block diagram of FIG. 14 for the rotor of the stepping motor having separation type coils will be described. The drive coil 305 of FIG. 14 is separated from the counter electromotive voltage detection coil 306 and connected to a drive circuit 110. The counter electromotive voltage detection coil 306 is connected to the differential amplifier 108. FIG. 14 comprises a vibration alarm set/reset circuit 105; a drive ON/OFF generating circuit 106; a battery voltage detection circuit 111; a drive pulse generating microcomputer 109 having a phase locking pulse generating means 112, an initial pulse generating means 113, a subsequent drive pulse generating means 114, a pulse width setting means 115, and a pulse interval setting means 116; a drive circuit 110; the counter electromotive voltage detection coil 306; the differential amplifier 108; and a zero crossing comparator 107. The vibration alarm set/reset circuit 105 outputs a vibration alarm generating pulse A at vibration alarm time. The drive ON/OFF generating circuit 106 outputs a drive ON/OFF signal B upon reception of the alarm generating pulse A. The battery voltage detection circuit 111 detects a battery voltage upon reception of a battery voltage detection designating signal D and outputs a battery voltage rank signal I. The phase locking pulse generating means 112 outputs a phase locking pulse C and the battery voltage detection designating signal D. The initial pulse generating means 113 outputs an initial pulse E and a subsequent drive pulse generating signal J. The subsequent drive pulse generating means 114 outputs a subsequent drive pulse H. The pulse width setting means 115 outputs, upon reception of the battery voltage rank signal I, a phase locking pulse width signal K, an initial pulse width signal L, a subsequent drive pulse width signal M, and a pulse interval signal N for the respective battery voltages in accordance with the phase locking pulse width, the initial pulse width, the subsequent drive pulse width, and the interval between the phase locking pulse and the initial pulse, respectively, that are set such that the stepping motor 301 can be stably started and stably rotated at a high speed even when an acceleration of a degree that can be generated in the respective battery voltages by, e.g., the swing of the arm, acts on the stepping motor 301. The pulse interval setting means 116 outputs an initial pulse generating signal 0. The drive circuit 110 supplies a drive current to the drive coil 305 upon reception of a drive pulse consisting of the phase locking pulse C, the initial pulse E, and the subsequent drive pulse H. The counter electromotive voltage detection coil 306 is separated from the drive coil 305 for driving the stepping motor 301 and detects a counter electromotive voltage generated when the rotor 303 is rotated. The differential amplifier 108 differentially amplifies the counter electromotive voltage Va generated in the counter electromotive voltage detection coil 306 and outputs the differential amplifier output F. The zero crossing comparator 107 outputs a zero crossing output G to the subsequent drive pulse generating means 114 upon reception of the differential amplifier output F as the output from the differential amplifier 108. The pulses, signals, and outputs A to H correspond to steps (a) and (b) of FIGS. 15, 22, 26, 29, 31, and 33.

Figure 14:
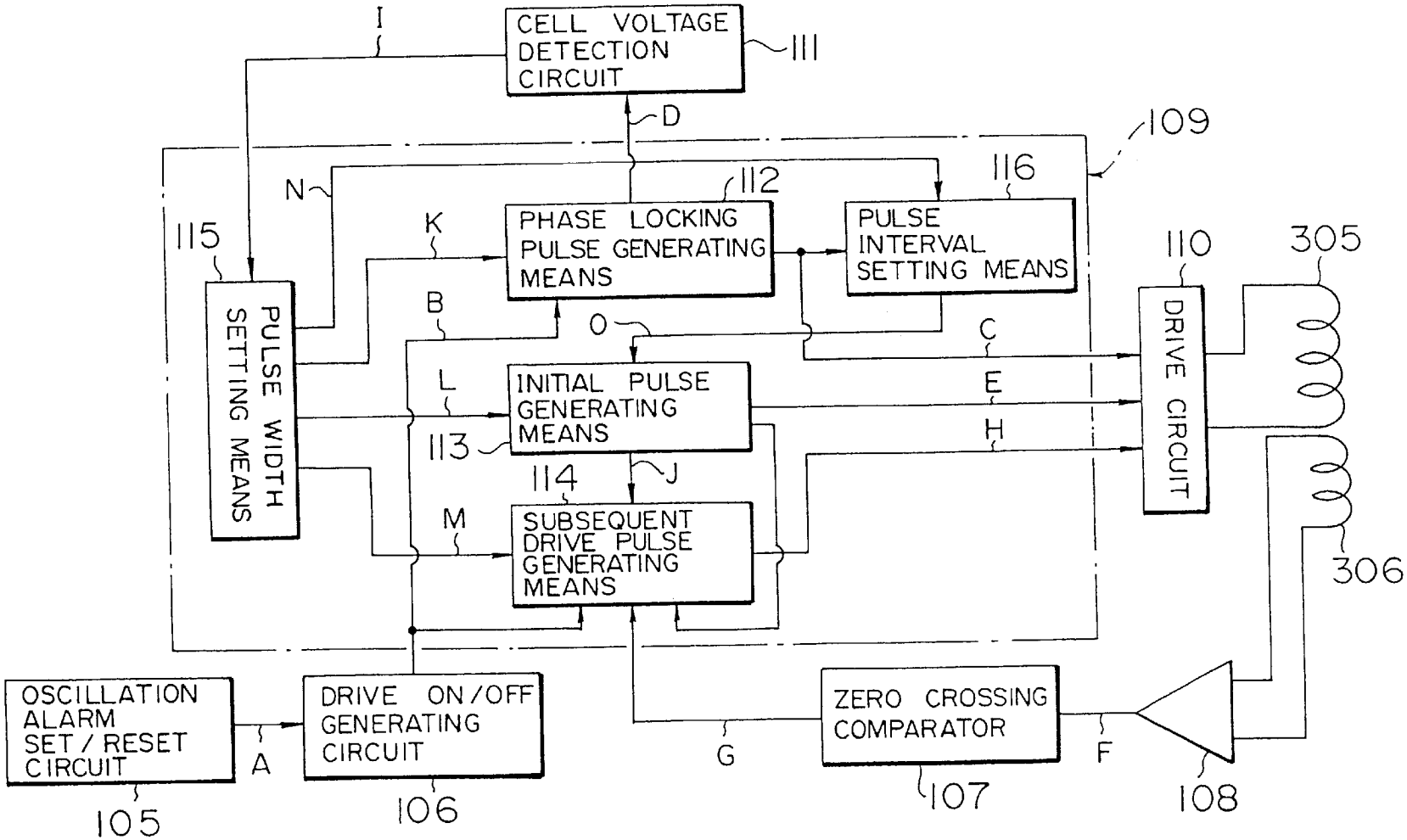
FIG. 14 is a block diagram of an embodiment of the high-speed rotation drive circuit of the rotor of a stepping motor having separation type coils, FIGS. 15(*a*) to 15(*h*) are charts of a case wherein the rotor of the stepping motor having the separation type coils is driven at a high speed.

The charts of FIGS. 15(*a*) to 15(*h*) of a case wherein the rotor of the stepping motor having separation type coils is driven at a high speed will be described with reference to the block diagram of FIG. 14 showing an embodiment of the high-speed drive circuit for the rotor of the stepping motor having the separation type coils. When preset vibration alarm time is reached, the vibration alarm set/reset circuit 105 outputs the vibration alarm generating pulse A shown in FIG. 15(*a*), and the drive ON/OFF generating circuit 106 outputs the drive ON/OFF signal B shown in FIG. 15(*b*). The phase locking pulse generating means 112 outputs the phase locking pulse C shown in FIG. 15(*c*) in order to start the rotor 303. The drive circuit 110 supplies the starting current to a drive coil 101 to rotate the rotor 303. At this time, it is not known whether or not the rotor magnet 308 of the rotor 303 is set still at a position where it can be started by the phase locking pulse C. More specifically, if the polarity of the magnetic poles caused in the stator 304 excited by the phase locking pulse C is the same as the polarity of the magnetic poles of the rotor magnet 308 of the rotor 303 that is opposite to the magnetic poles of the stator 304, the rotor 303 is rotated; if it is different from the polarity of the magnetic poles of the rotor magnet 308 of the rotor 303, the rotor 303 is not rotated. However, the polarity of the magnetic poles caused in the stator 304 excited by the drive pulse subsequent to the phase locking pulse C, i.e., by the initial pulse E and the subsequent drive pulse H is the same as the polarity of the magnetic poles of the rotor magnet 308 having the rotor 303, which latter polarity is opposite to the polarity of the stator 304. Therefore, the subsequent drive pulse can rotate the rotor 303.

Figure 15:
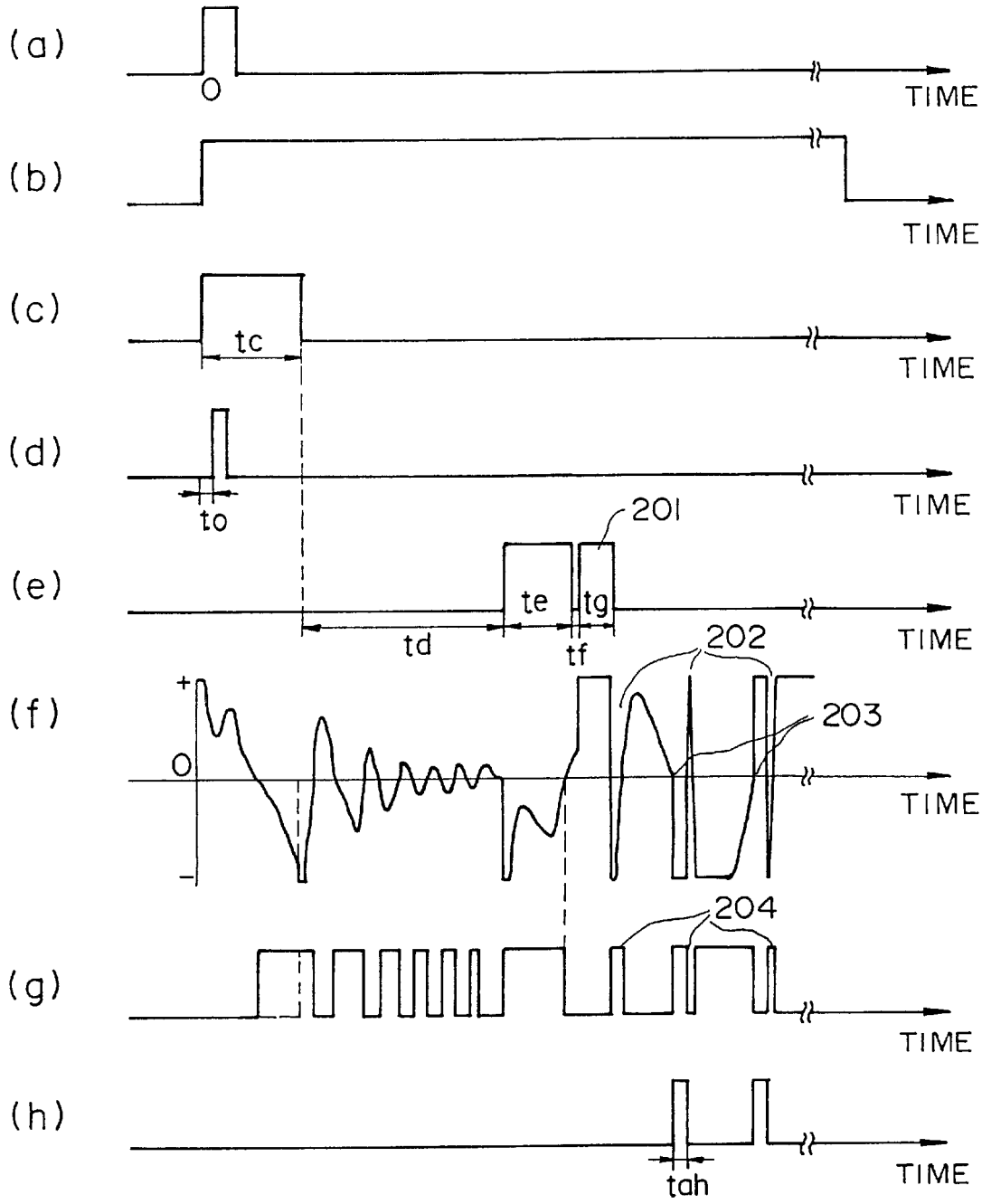

The phase locking pulse generating means 112 outputs the battery voltage detection designating signal D shown in FIG. 15(*d*) to the battery voltage detection circuit 111 t0 after the rise of the phase locking pulse C. The battery voltage detection circuit 111 detects the battery voltage and outputs the battery voltage rank signal I to the pulse width setting means 115. Upon reception of the battery voltage, the pulse width setting means 115 outputs, to the phase locking pulse generating means 112, the initial pulse generating means 113, the subsequent drive pulse generating means 114, and the pulse interval setting means 116, the phase locking pulse width signal K, the initial pulse width signal L, the subsequent drive pulse width signal M, and the pulse interval signal N in accordance with the phase locking pulse width, the initial pulse width, the subsequent drive pulse width, and the interval between the phase locking pulse and the initial pulse, that are set so that the stepping motor 301 can be stably started and stably rotated at a high speed even when an acceleration of a degree that can be generated in the battery voltage by, e.g., the swing of the arm, acts on the stepping motor 301. Upon reception of the phase locking pulse width signal K, the phase locking pulse generating means 112 outputs the phase locking pulse C having a pulse width (tc) corresponding to the battery voltage detected by the battery voltage detection circuit 111 to the drive circuit 110. The pulse interval setting means 116 outputs the initial pulse generating signal O formed of the phase locking pulse C and the pulse interval signal N to the initial pulse generating means 113.

Figure 18:
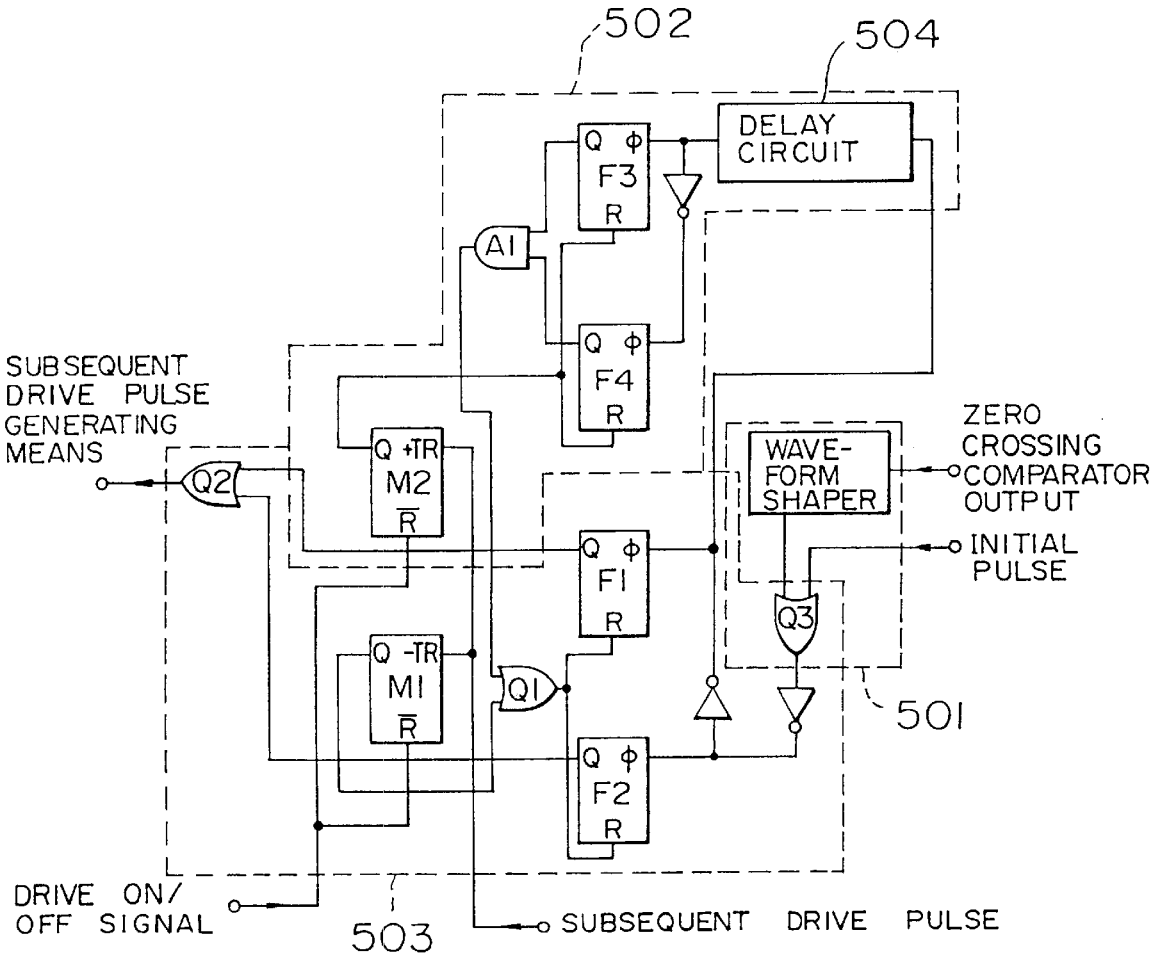
FIG. 18 is a diagram of a circuit for masking a spike pulse in the digital manner.

The initial pulse generating means 113 outputs, upon reception of the initial pulse width signal L, the initial pulse E having a pulse width (te) corresponding to the battery voltage detected by the battery voltage detection circuit 111 and, upon reception of the initial pulse generating signal O, it outputs, td after the fall of the phase locking pulse C, an auxiliary initial pulse 201 (the initial pulse E includes the auxiliary initial pulse hereinafter unless otherwise noted) having a pulse width tg, that aids the driving operation of the stepping motor at a fall tf of the initial pulse E by the initial pulse E, to the drive circuit 110. The differential amplifier output F of the differential amplifier 108 connected to the counter electromotive voltage detection coil 306 is shown in FIG. 15(*f*). Spike noise 202 (referring to noise corresponding to the fall of the subsequent drive pulse H hereinafter unless otherwise specified) is superposed on the differential amplifier output F. Upon reception of the differential amplifier output F, the zero crossing comparator 107 outputs the zero crossing comparator output G to the subsequent drive pulse generating means 114, as shown in FIG. 15(*g*). A spike pulse 204 corresponding to the spike noise 202 is superposed on the zero crossing comparator output G. However, the subsequent drive pulse generating means 114 has a function of masking the spike pulse 204 corresponding to the spike noise 202 in the digital manner, as shown in FIG. 18 to be described later. Thus, after the subsequent drive pulse generating signal from the initial pulse generating means 113 is input, the subsequent drive pulse generating means 114 outputs the subsequent drive pulse H having a pulse width (tah) smaller than the phase locking pulse width (tc) or the starting pulse width (te) corresponding to the battery voltage detected by the battery voltage detection circuit 111, as shown in FIG. 15(*h*), in synchronism with times corresponding to the zero crossing points 203 shown in FIG. 15(*f*), that are the rise time and fall time of the zero crossing comparator output G shown in FIG. 15(*g*) excluding the rise time and fall time of the spike pulse 204. The stepping motor 301 is constantly accelerated by the subsequent drive pulse H and can rotate the rotor 303 at a high speed with a rotational speed matching the frictional resistance acting on the rotor 303.

Figure 17A:
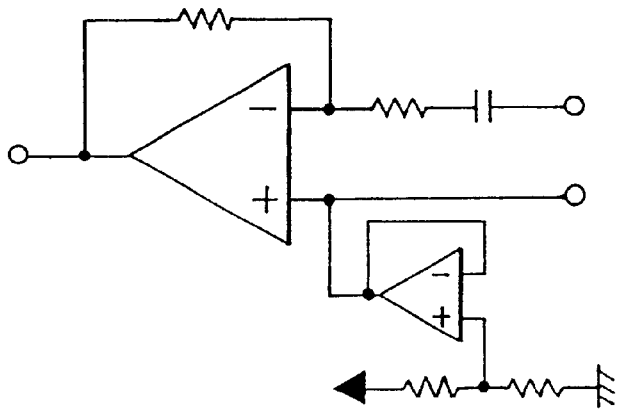
FIGS. 17A and 17B are circuit diagrams of differential amplifiers of high-speed drive circuits of stepping motors each having separation type coils.
Figure 17B:
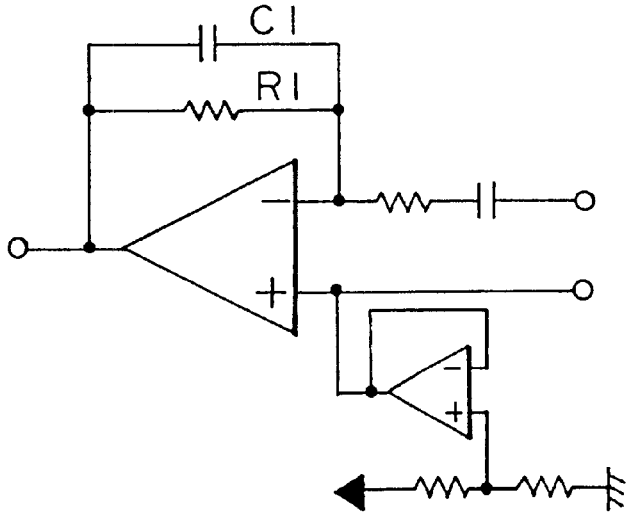

As the rotational speed of the stepping motor is increased, the subsequent drive pulse generating means 114 decreases the pulse width (tah) of the subsequent drive pulse H and sets it to a pulse width (tah) optimal as the rotational speed of the stepping motor. In this embodiment, since the differential amplifier 108 shown in FIG. 17A does not have a low-pass filter, a time lag is not caused in the output F from the differential amplifier 108 by a low-pass filter (to be referred to as an R1C1 low-pass filter hereinafter) constituted by a resistor R1 and a capacitor C1 shown in FIG. 17B. Hence, a rotational angle $\theta$ corresponding to the rise and fall of the zero crossing comparator output G excluding the spike pulse 204 is substantially $-\theta_0$ or $\pi-\theta_0$. When compared to a differential amplifier having an R1C1 low-pass filter, the stepping motor can be sufficiently accelerated before rotation of its rotor is braked (braking is performed when $\theta=0$ to $\pi/2$ or $\pi$ to $3\pi/2$) by the detent torque, thereby increasing the rotational speed of the rotor.

Figure 19:
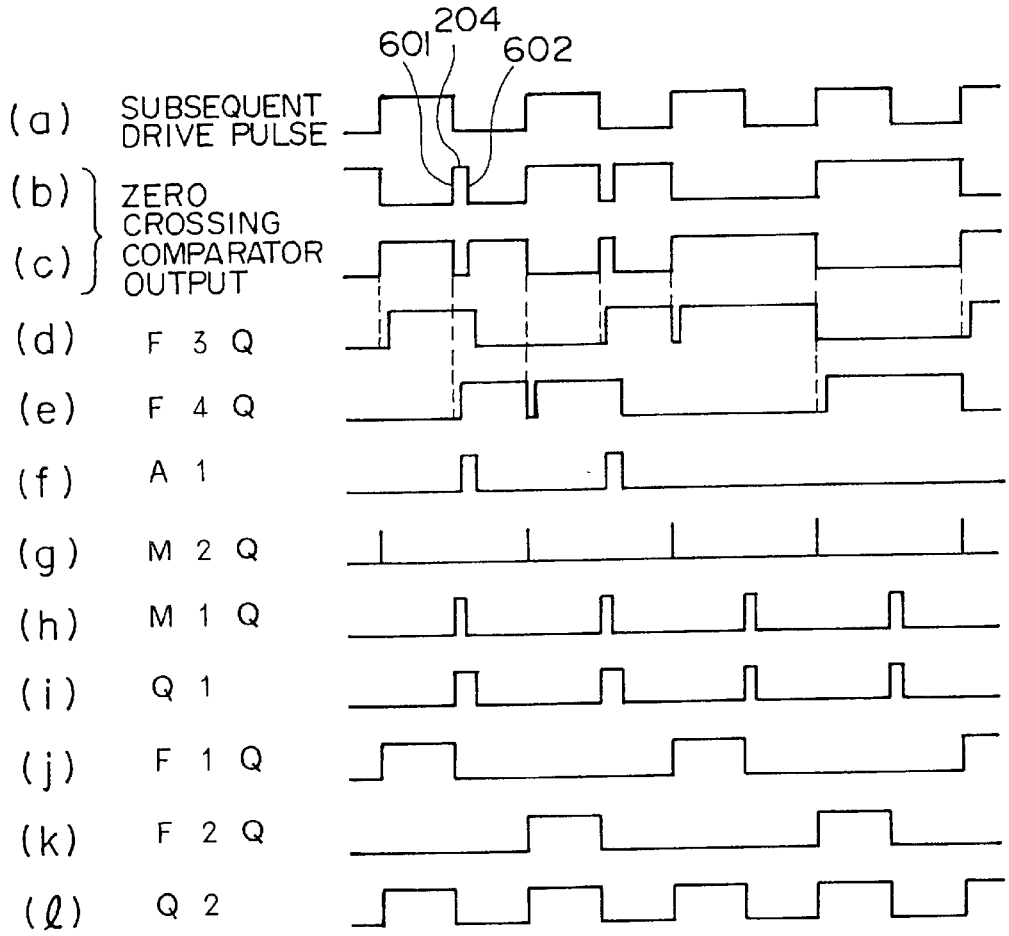
FIG. 19 is a timing chart of the circuit for masking the spike pulse in the digital manner.
Figure 20:
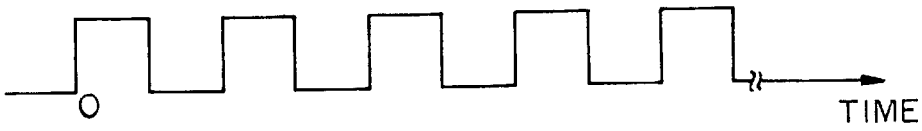
FIG. 20 shows a change in stepping motor drive pulse over time according to the present invention.

The function of the circuit shown in FIG. 18 for masking the spike pulse in the digital manner will be described with reference to the timing chart of FIG. 19. As the starting pulse constituted by the phase locking pulse and the initial pulse is output from the phase locking pulse generating means and the initial pulse generating means independently of the zero crossing comparator output G, FIG. 19(*a*) shows a subsequent drive pulse after the starting pulse. As the spike pulse 204 is not sometimes generated when the rotational speed of the stepping motor is increased, FIG. 19(*b*) shows a zero crossing comparator output G in which a spike pulse 204 is generated, and a zero crossing comparator output G in which a spike pulse 204 is not generated. FIG. 18 comprises blocks 501, 502, and 503. The block 501 masks inversion of the zero crossing comparator output G which is caused in the zero crossing comparator output G by the initial pulse E (the initial pulse E is an initial pulse E excluding the auxiliary initial pulse). The block 502 masks a back edge 602 of the spike pulse 204. The block 503 masks a front edge 601 of the spike pulse 204 and deals with the zero crossing comparator output G in which the spike pulse 204 is not generated. In the block 501, the zero crossing comparator output G is input to a waveform shaper that changes a multi-rise and a multi-fall at the rise and fall of the zero crossing comparator output G to a single rise and a single fall, is waveform-shaped, and is ORed with the initial pulse E. Thus, inversion of the zero crossing comparator output G which occurs before the initial pulse E ends is avoided.

In the block 502, in order to mask the back edge 602 of the spike pulse 204, the zero crossing comparator output G is supplied to a delay circuit 504. Upon reception of inverted and non-inverted outputs from the delay circuit 504, flip-flop circuits F3 and F4 generate outputs F3Q (d) and F4Q (e), respectively. Then, an AND circuit A1 generates an output A1 (f) as an ANDed output of the outputs F3Q (d) and F4Q (e). The flip-flop circuits F3 and F4 are reset by a glitch pulse output M2Q (g) from a pulse generator M2 at a rise of the subsequent drive pulse H (a). In the block 503, flip-flop circuits F1 and F2 generate outputs F1Q (j) and F2Q (k) upon reception of an inverted zero crossing comparator output G (c) and a non-inverted zero crossing comparator output G (b), respectively. An ORed output Q2 (1) of the outputs F1Q (j) and F2Q (k) is output in order to generate a subsequent drive pulse H. In order to mask the spike pulse 204, the flip-flop circuits Fl and F2 are reset by an ORed output Q1 (i) of an output pulse M1Q (h) output from a pulse generator M1 at a fall of a subsequent drive pulse H (a) for masking the front edge 601 and the output A1 (f) for masking the back edge 602.

Figure 21:
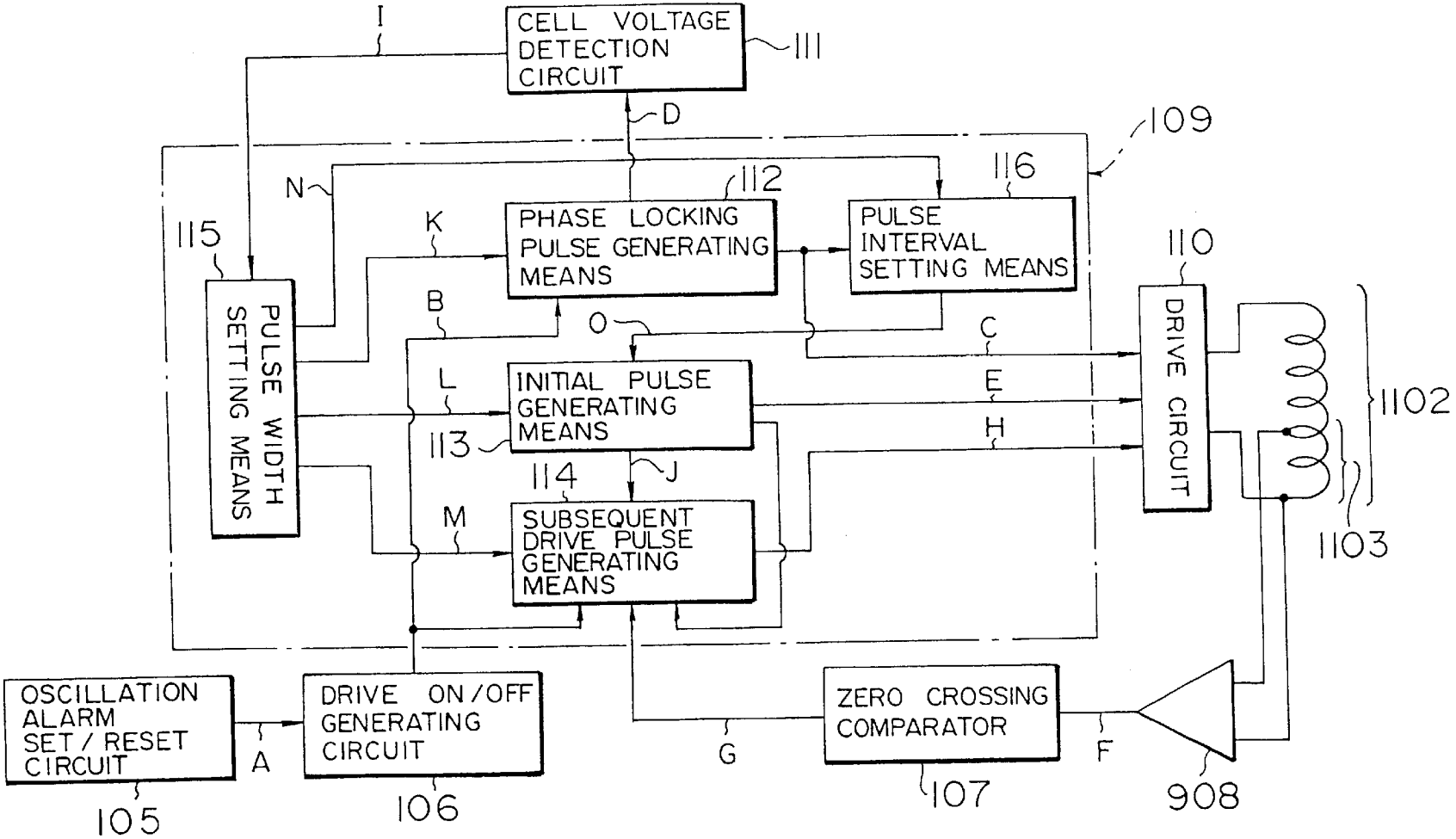
FIG. 21 is a block diagram of an embodiment of the high-speed drive circuit of the rotor of a stepping motor having a tapped coil, FIGS. 22(*a*) to 22(*h*) are charts of a case wherein the rotor of the stepping motor having the tapped coil is driven at a high speed.
Figure 22:
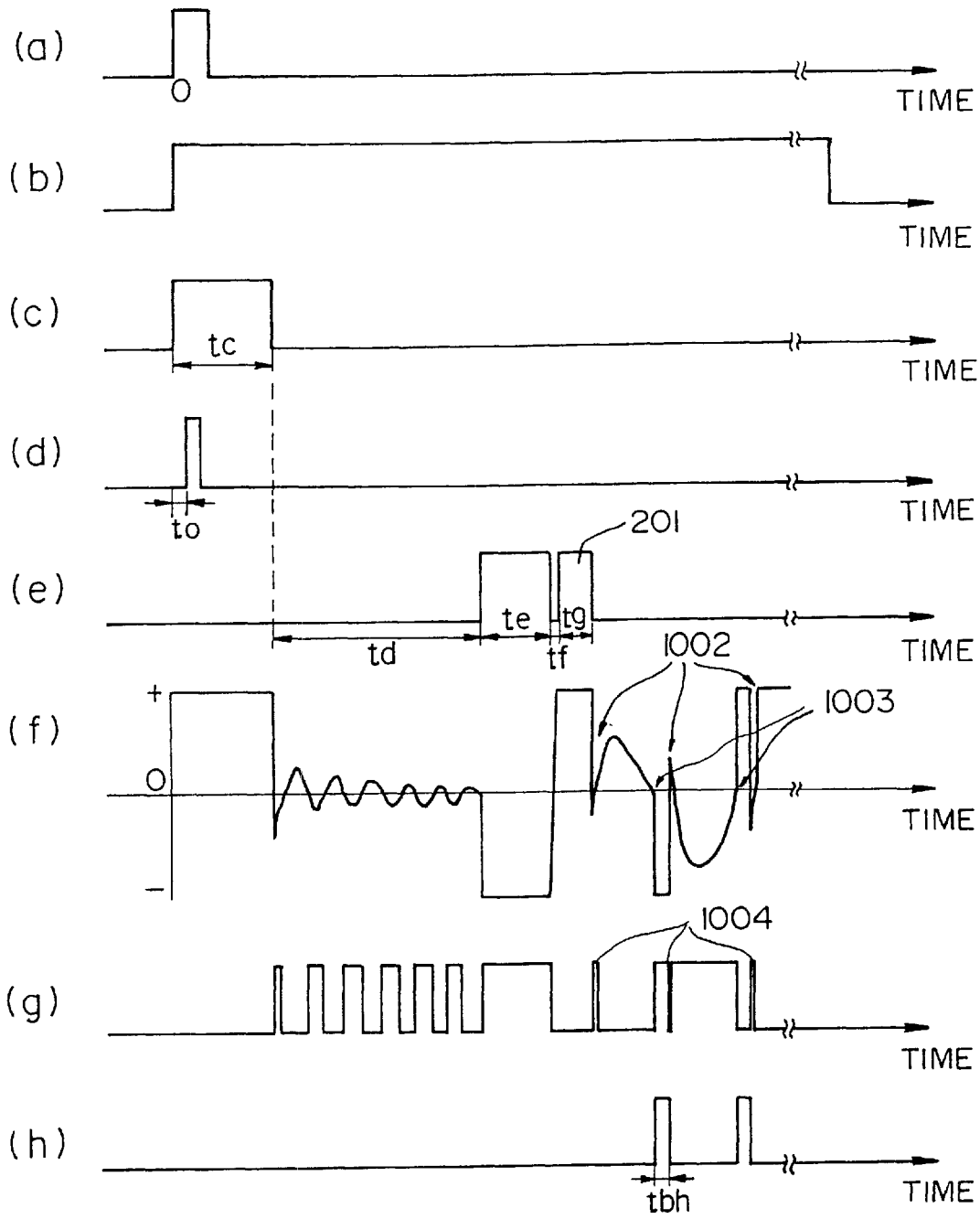
Figure 23A:
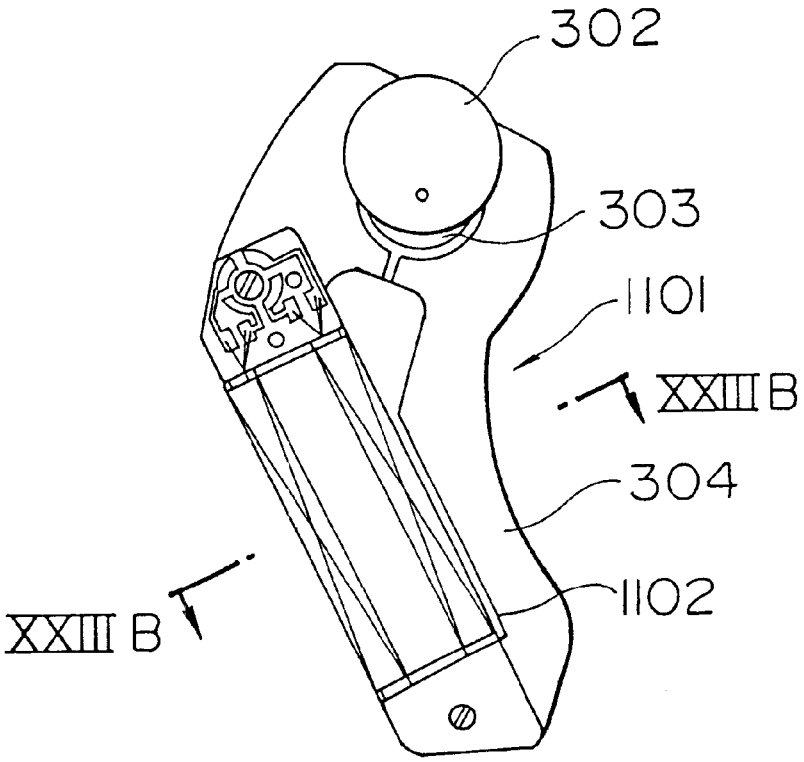
FIG. 23A is a plan view of the stepping motor having the tapped coil for driving a vibration alarm.
Figure 23B:
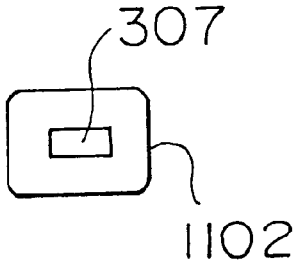
FIG. 23B is a sectional view taken along the line XXIIIB—XXIIIB of FIG. 23A, FIGS. 24A and 24B are circuit diagrams of differential amplifiers of high-speed drive circuits of stepping motors each having tapped coils.
Figure 24A:
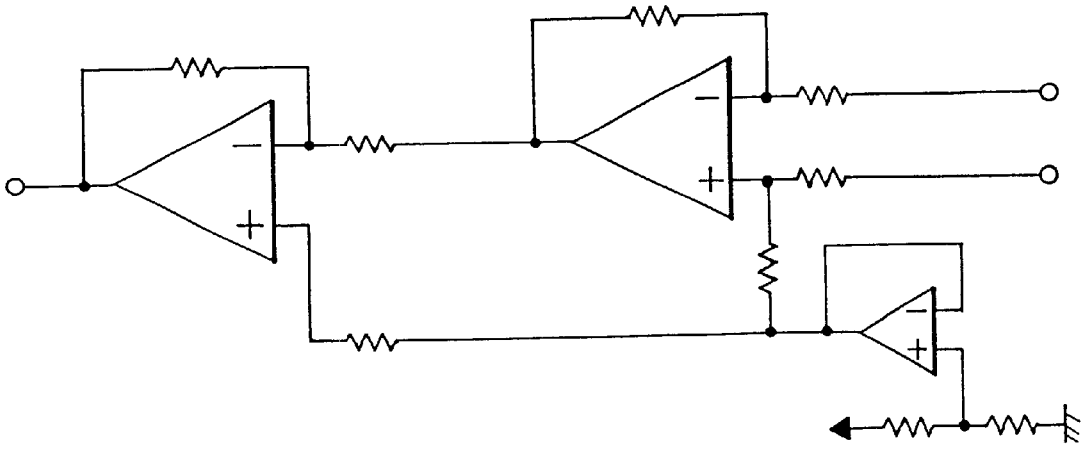
Figure 24B:
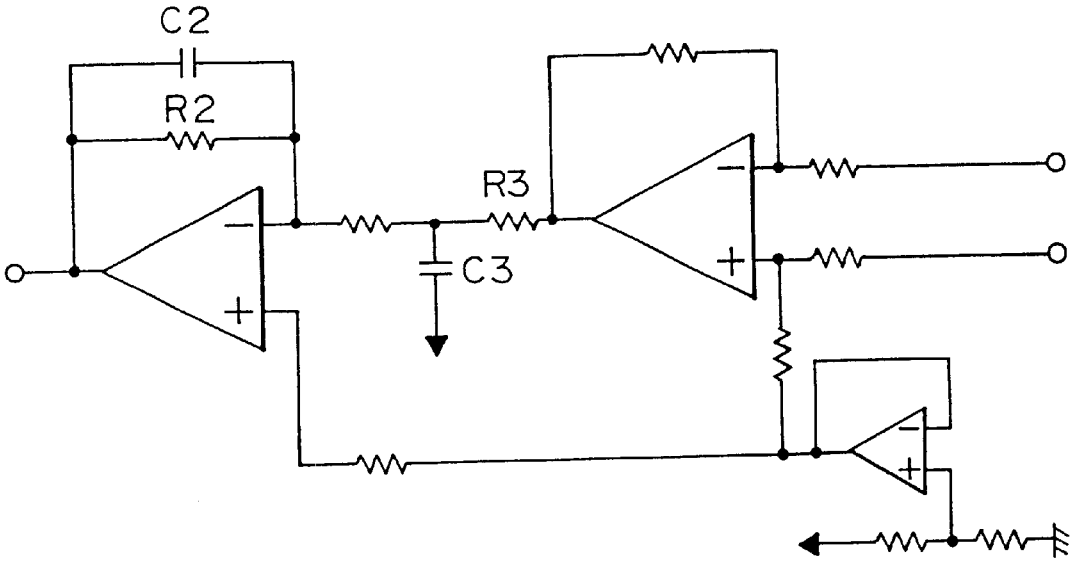

An embodiment using a tapped coil will be described with reference to FIGS. 21 to 24B. FIG. 23A is a plan view of a stepping motor for driving a vibration alarm in a tapped coil, and FIG. 23B is a sectional view taken along the line XXIIIB—XXIIIB of FIG. 23A. The plan view of the stator and rotor is the same as that of FIG. 16C. A stepping motor 1101 comprises a rotor 303 provided with an eccentric weight 302, a stator 304, and a drive coil 1102. As shown in FIG. 21, a counter electromotive voltage detection coil 1103 is a coil constituted by the entire drive coil 1102, or obtained by removing the tap from part of the drive coil 1102.

The counter electromotive voltage generated in the counter electromotive voltage detection coil 1103 will be described. A counter electromotive voltage Vb generated in the counter electromotive voltage detection coil, including a voltage drop Rb·ib caused by a drive coil DC resistance Rb of the counter electromotive voltage detection coil, can be obtained in accordance with the following equation (7):

$$Vb=-Lb\cdot(dib/dt)-Kb\cdot\sin(\theta+\theta_0)\cdot(d\theta/dt)-Rb\cdot ib \quad (7)$$

where ib is the current flowing in the counter electromotive voltage detection coil.

In equation (7), $-Lb\leftrightarrows(dib/dt)$ is obtained by inverting the sign of the product of an equivalent self-inductance Lb (the equivalent self-inductance Lb is (nb2+nb·nb0)/Rm where nb is the number of turns of the counter electromotive voltage detection coil 1103, nb0 is the number of turns of a coil portion of the drive coil not used by the counter electromotive voltage detection coil 1103, and Rm is the magnetic resistance of the magnetic circuit of the stepping motor) of the counter electromotive voltage detection coil 1103 and the change in the drive current ib over time. $-Lb\cdot(dib/dt)$ is generated when the drive current ib changes over time. $-Kb\cdot\sin(\theta+\theta_0)\cdot(d\theta/dt)$ is obtained by inverting the sign of the product of a mechanical coupling coefficient Kb with respect to the stepping motor 1101, $\sin(\theta+\theta_0)$, and a change in a rotational angle θ over time, i.e., the angular velocity, of the rotor 303. $-Kb\cdot\sin(\theta+\theta_0)\cdot(d\theta/dt)$ is generated when the rotor 303 is rotated. $\theta_0$ is the initial angle of the rotor 303. In the plan view of FIG. 16C showing the stator and the rotor, $\theta_0$ is the angle from the position of the magnetic pole N (S) of a rotor magnet 308 of the rotor 303, which is set still by the detent torque, to the position of almost 90° from a slit 309 of the stator 304.

An output Vgb of a differential amplifier (to be described later) can be obtained in accordance with the following equation (8):

$$Vgb=-Gb\cdot Lb\cdot(dib/dt)-Gb\cdot Kb\cdot\sin(\theta+\theta_0)\cdot(d\theta/dt)-Gb\cdot Rb\cdot ib \quad (8)$$

Vgb of equation (8) is a differential amplifier output F of a differential amplifier 908 in the block diagram of the high-speed drive circuit shown in FIG. 21 (to be described later) for the rotor of the stepping motor. By detecting a time point when $-Gb\cdot Kb\cdot\sin(\theta+\theta_0)\cdot(d\theta/dt)=0$, the rotational angle θ $(-\theta_0,-\theta_0+\pi)$, shown in FIG. 16C, of the rotor 303 from the position of the magnetic pole N (S) of the rotor magnet 308 of the rotor 303 which is set still by the detent torque can be detected. Note that Gb represents the gain of the differential amplifier 908. Although the output Vgb of the differential amplifier of the tapped coil includes $-Gb\cdot Lb\cdot(dib/dt)-Gb\cdot Rb\cdot ib$ caused by the change in the drive current ib over time in the drive coil, it can be neglected.

The arrangement of the block diagram of FIG. 21 showing an embodiment of a high-speed drive circuit for the rotor of a stepping motor having a tapped coil will be described. FIG. 21 is different from the block diagram of FIG. 14 showing the embodiment of the high-speed drive circuit for the rotor of the stepping motor, in the drive coil 305, the connecting method of the drive coil 305 and the drive circuit 110, the connecting method of the drive coil 305 and the differential amplifier 108, and the differential amplifier 108. The drive coil 1102 in FIG. 21 is connected to a drive circuit 110, and the counter electromotive voltage detection coil 1103 is connected to the differential amplifier 908. Except that, FIG. 21 is the same as FIG. 14, and a detailed description thereof will thus be omitted.

The charts shown in FIGS. 22(*a*) to 22(*h*) of high-speed driving of the rotor of the stepping motor having the tapped coil will be described with reference to the block diagram of FIG. 21 showing the embodiment of the high-speed drive circuit for the rotor of the stepping motor having the tapped coil. Since FIGS. 22(*a*) to 22(*e*) are similar to FIGS. 15(*a*) to 15(*e*), a detailed description thereof will be omitted. The differential amplifier output F of the differential amplifier 908 connected to the counter electromotive voltage detection coil 1103 is shown in FIG. 22(*f*). Spike noise 1002 is superposed on the differential amplifier output F. Upon reception of the differential amplifier output F, the zero crossing comparator 107 outputs the zero crossing comparator output G to the subsequent drive pulse generating means 114, as shown in FIG. 22(*g*). A spike pulse 1004 corresponding to the spike noise 1002 is superposed on the zero crossing comparator output G. However, the subsequent drive pulse generating means 114 has a function of masking the spike pulse 1004 corresponding to the spike noise 1002 in the digital manner, as shown in FIG. 18. Thus, after the subsequent drive pulse generating signal J from the initial pulse generating means 113 is input, in response to the zero crossing point 1003 shown in FIG. 22(*f*), the subsequent drive pulse generating means 114 outputs the subsequent drive pulse H having a pulse width (tbh) smaller than the phase locking pulse width (tc) or the initial pulse width (te) corresponding to the battery voltage detected by the battery voltage detection circuit 111, as shown in FIG. 22(*h*), in synchronism with the rise time and fall time of the zero crossing comparator output G shown in FIG. 22(*g*) excluding the rise time and fall time of the spike pulse 1004. The stepping motor 1101 is constantly accelerated by the subsequent drive pulse H and can rotate the rotor 303 at a high speed with a rotational speed matching the frictional resistance acting on the rotor 303. As the rotational speed of the stepping motor is increased, the subsequent drive pulse generating means 114 decreases the pulse width (tbh) of the subsequent drive pulse H and sets it to a pulse width (tbh) optimal as the rotational speed of the stepping motor. In this embodiment, since the differential amplifier 908 shown in FIG. 24A does not have R2C2 and R3C3 low-pass filters shown in FIG. 24B, a time lag is not caused in the output F from the differential amplifier 908 by these low-pass filters. Hence, a rotational angle θ corresponding to the rise and fall of the zero crossing comparator output excluding the spike pulse 1004 is substantially $-\theta_0$ or $\pi-\theta_0$. When compared to a differential amplifier having a low-pass filter, the stepping motor can be sufficiently accelerated before rotation of its rotor is braked (braking is performed when θ=0 to π/2 or π to 3π/2) by the detent torque, thereby increasing the rotational speed of the rotor.

Figure 26:
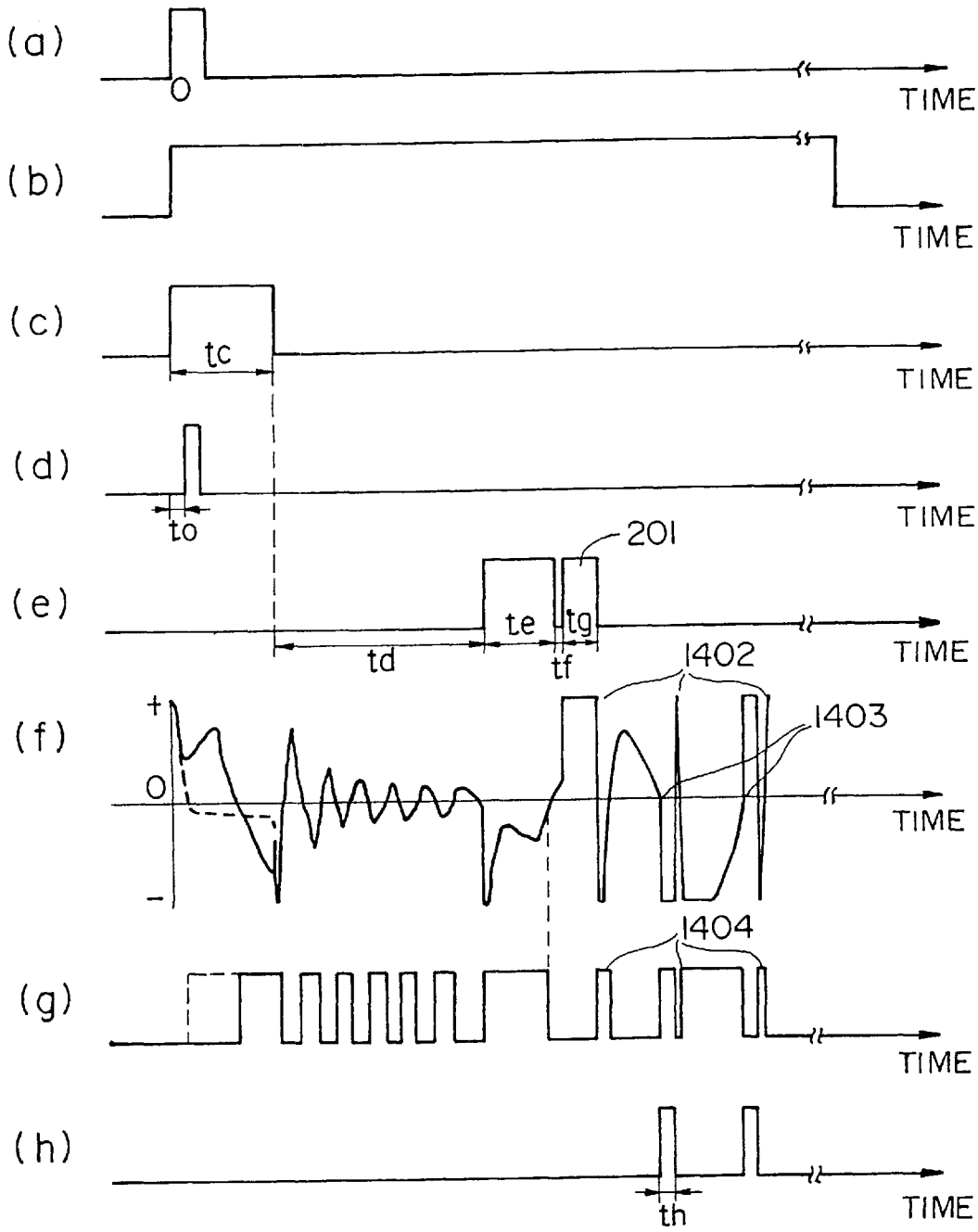
Figure 27A:
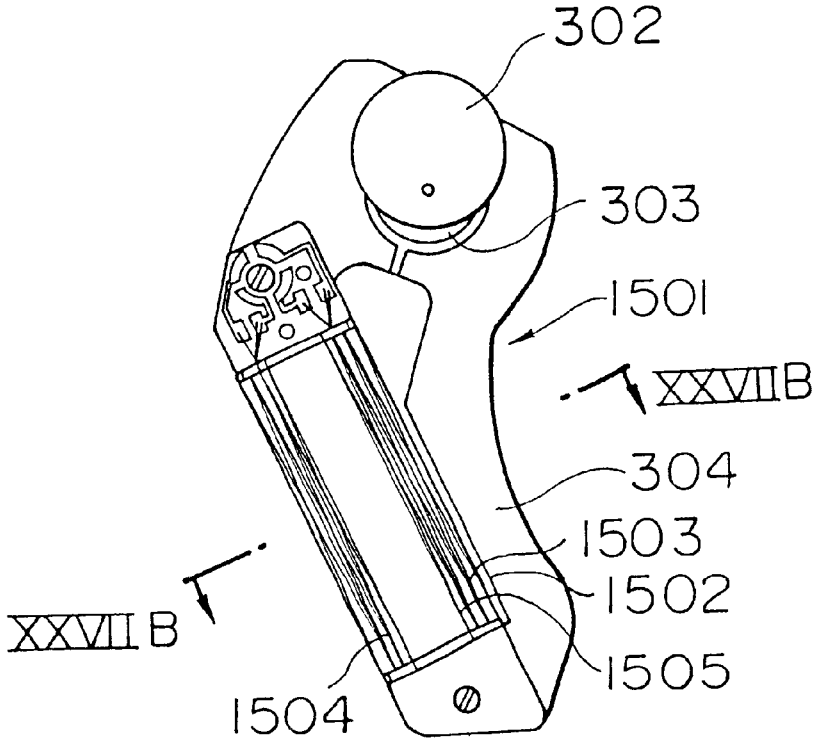
FIG. 27A is a plan view of a stepping motor having a cancel coil for driving a vibration alarm.
Figure 27B:
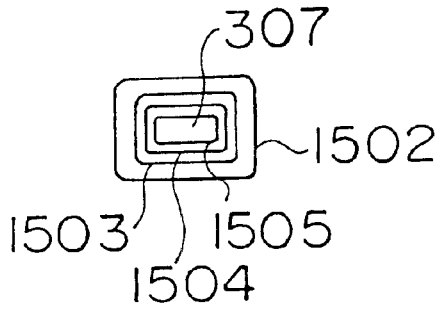
FIG. 27B is a sectional view taken along the line XXVIIB—XXVIIB of FIG. 27A.
Figure 28:
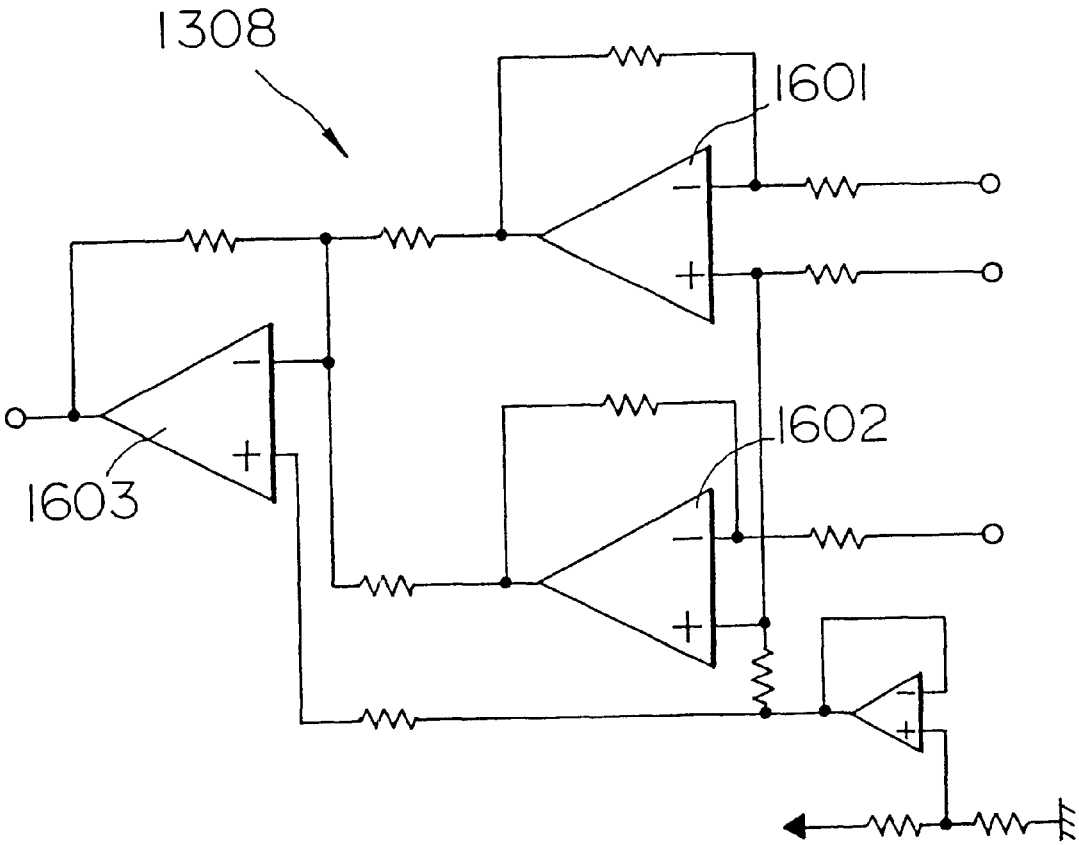
FIG. 28 is a circuit diagram of an adder having no low-pass filter.
Figure 29:
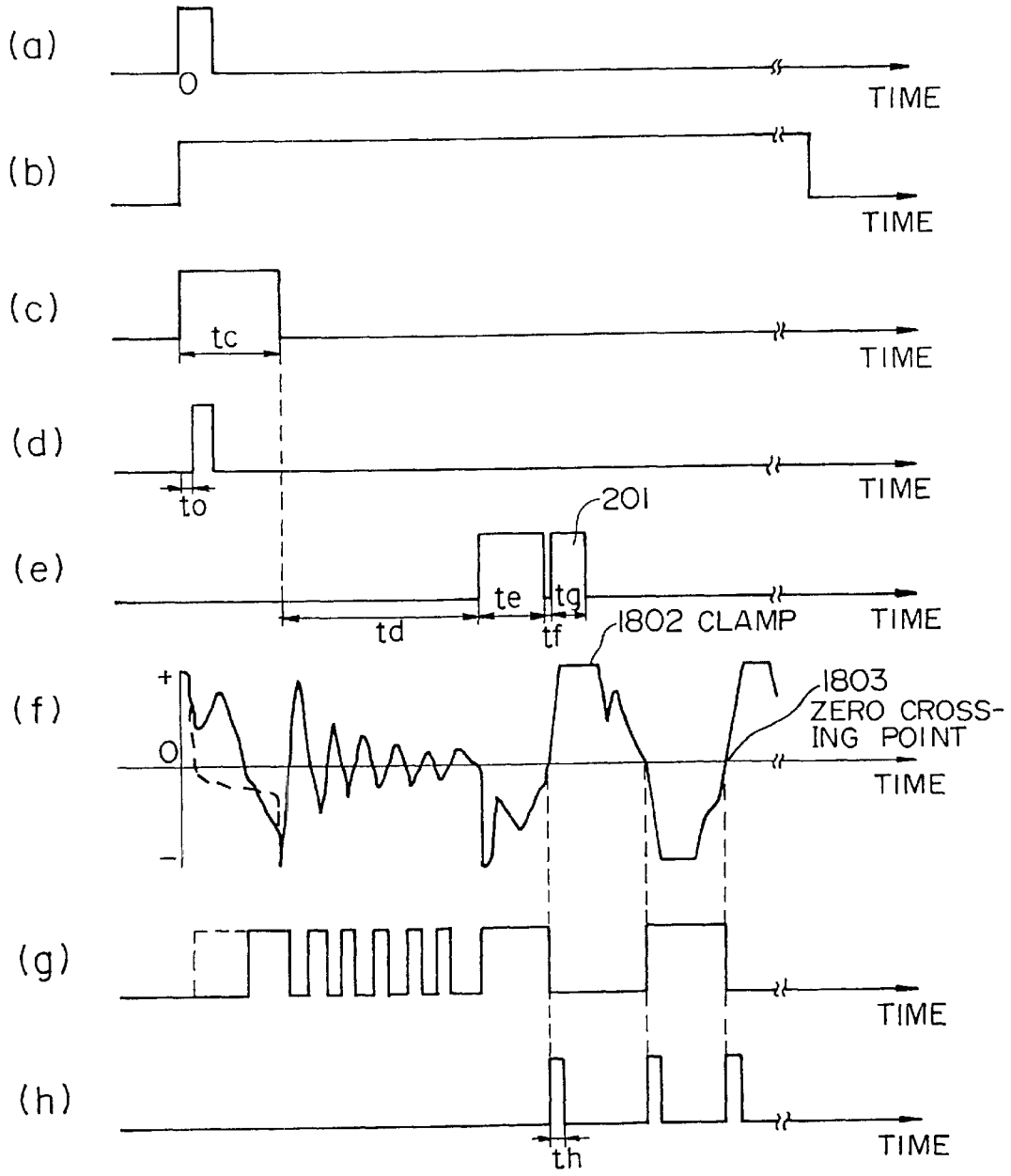
FIG. 29 shows charts of a case wherein the rotor of the stepping motor having the cancel coil is driven at a high speed.

An embodiment using a cancel type coil will be described with reference to FIGS. 25 to 31. FIG. 27A is a plan view of a stepping motor for driving a vibration alarm in a cancel coil, and FIG. 27B is a sectional view taken along the line XXVIIB—XXVIIB of FIG. 27A. The plan view of the stator and the rotor is identical to that of FIG. 16C. A stepping motor 1501 comprises a rotor 303 having an eccentric weight 302, a stator 304, and a drive coil 1502. The drive coil 1502 comprises an effective drive coil 1503 and two rotor-generated counter electromotive voltage detection coils 1504 and 1505 having the same drive coil DC resistance and self-inductance and different directions of winding. The rotor-generated counter electromotive voltage detection coils 1504 and 1505 are connected in series to the effective drive coil 1503 in order to detect the positions of the magnetic poles of the rotor 303.

The counter electromotive voltage generated in the rotor-generated counter electromotive voltage detection coils 1504 and 1505 will be described. A counter electromotive voltage Vc generated in the rotor-generated counter electromotive voltage detection coil 1504, including a voltage drop Rc·iC caused by a drive coil DC resistance Rc of the rotor-generated counter electromotive voltage detection coil 1504, can be obtained in accordance with the following equation (9):

$$Vc=-Lc\cdot(di_c/dt)-Kc\cdot\sin(\theta+\theta_0)\cdot(d\theta/dt)-Rc\cdot i_c \quad (9)$$

In equation (9), $-Lc\cdot(di_c/dt)$ is obtained by inverting the sign of the product of an equivalent self-inductance Lc (the equivalent self-inductance Lc is $Lc=n_{0c}\cdot n_c/Rm$ where $n_{0c}$ and $n_c$ are the numbers of turns of the effective drive coil and the rotor-generated counter electromotive voltage detection coil, and Rm is the magnetic resistance of the magnetic circuit of the stepping motor) of the rotor-generated counter electromotive voltage detection coil 1504 and the change in the drive current iC over time. $-Lc\cdot(di_c/dt)$ is generated when the drive current iC changes over time. $-Kc\cdot\sin(\theta+\theta_0)\cdot(d\theta/dt)$ is obtained by inverting the sign of the product of a mechanical coupling coefficient K with respect to the stepping motor 1501, $\sin(\theta+\theta_0)$, and a change in a rotational angle θ over time, i.e., the angular velocity, of the rotor 303. $-Kc\cdot\sin(\theta+\theta_0)\cdot(d\theta/dt)$ is generated when the rotor 303 is rotated. $\theta_0$ is the initial angle of the rotor 303. In the plan view of FIG. 16C showing the stator and the rotor, $\theta_0$ is the angle from the position of the magnetic pole N (S) of a rotor magnet 308 of the rotor 303, which is set still by the detent torque, to the position of almost 90° from the slit 309 of the stator 304.

A counter electromotive voltage Vd generated in the rotor-generated counter electromotive voltage detection coil 1505, including a voltage drop Rd·id caused by a drive coil DC resistance Rd of the rotor-generated counter electromotive voltage detection coil 1505, can be obtained in accordance with the following equation (10):

$$Vd=-Ld\cdot(di_d/dt)-Kd\cdot\sin(\theta+\theta_0)\cdot(d\theta/dt)+Rd\cdot i_d \quad (10)$$

Similarly, Vd in equation (10) is the sum of $-Ld\cdot(di_{d/dt})$, $-Kd\cdot\sin(\theta+\theta_0)\cdot(d\theta/dt)$ and $Rd\cdot i_d$. Since the drive currents ic and −id, the drive coil DC resistances Rc and Rd, the equivalent self-inductances Lc and −Ld, and the mechanical coupling coefficients Kc and Kd are respectively equal to i (−i), R, L (−L), and K, Vd is different from Vc described above only in that the sign of R·i is different because the direction of the drive current i is different.

An output V of an adder (to be described later) is obtained in accordance with the following equation (11):

$$V=-2\cdot G\cdot L\cdot(di/dt)-2\cdot G\cdot K\cdot\sin(\theta+\theta_0)\cdot(d\theta/dt) \quad (11)$$

Figure 25:
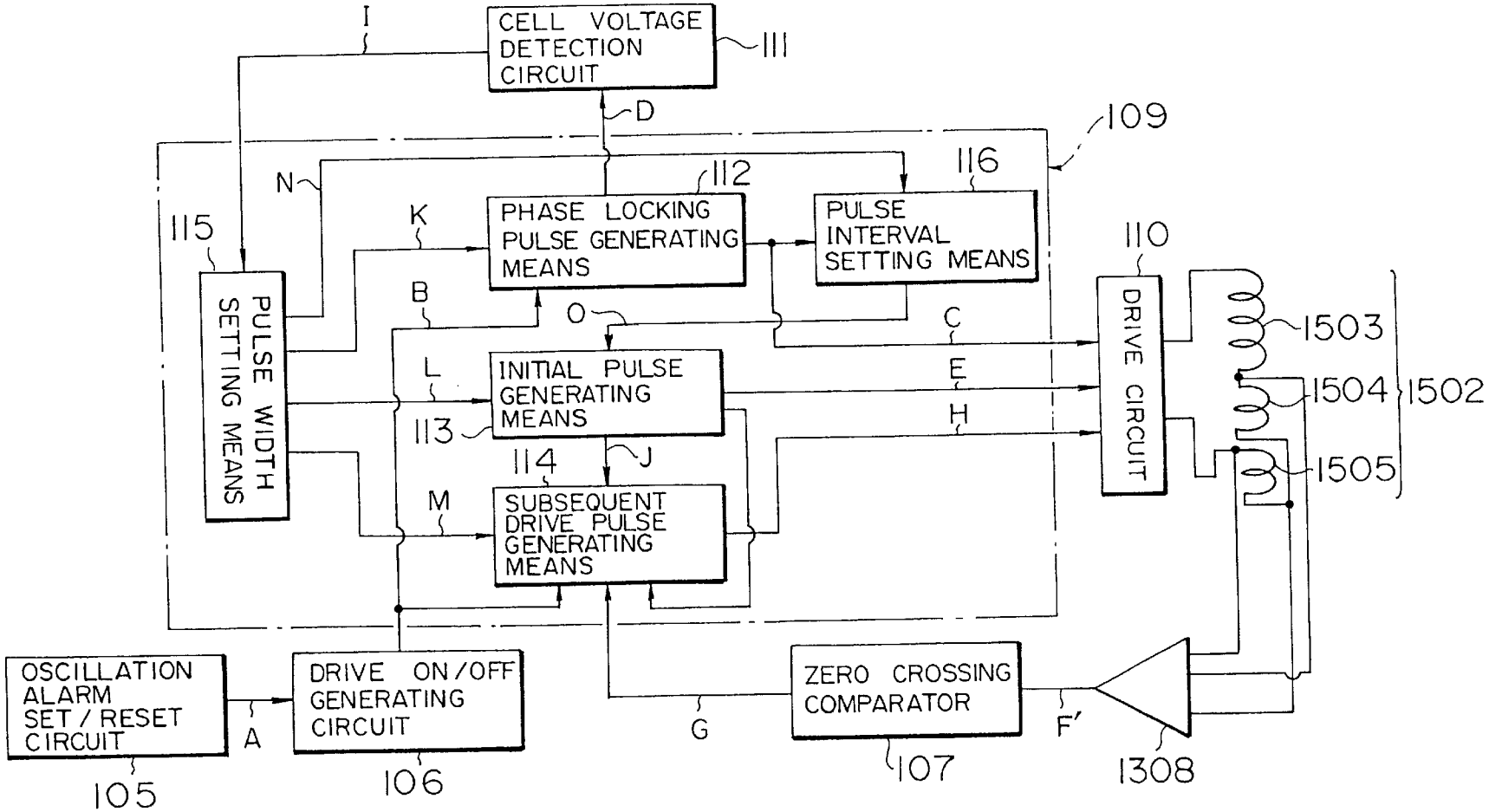
FIG. 25 is a block diagram of an embodiment of the high-speed drive circuit of the rotor of a stepping motor having a cancel coil, FIGS. 26(*a*) to 26(*h*) are charts of still another case wherein the rotor of a stepping motor having a cancel coil is rotated at a high speed.

V in equation (11) is an adder output F of an adder 1308 of the block diagram of FIG. 25 showing a high-speed drive circuit for the rotor of the stepping motor (to be described later). When Vc and Vd are added, the voltage drop caused by the drive coil DC resistance is canceled, and the addition result becomes the sum of $-2\cdot G\cdot L\cdot(di/dt)$ and the counter electromotive voltage $-2\cdot G\cdot K\cdot\sin(\theta+\theta_0)\cdot(d\theta/dt)$ generated by rotation of the rotor 303. By detecting a time point when $-2\cdot G\cdot K\cdot\sin(\theta+\theta_0)\cdot(d\theta/dt)=0$, the rotational angle θ ($-\theta_0$, $-\theta_0+\pi$), shown in FIG. 16C, of the rotor 303 from the position of the magnetic pole N (S) of the rotor magnet 308 of the rotor 303 which is set still by the detent torque can be detected. Note that G denotes the gain of the adder 1308. $-2\cdot G\cdot L\cdot(di/dt)$ of equation (11) can be neglected and does not influence detection. As the directions of the drive currents i of the rotor-generated counter electromotive voltage detection coils 1504 and 1505 are different, they do not contribute to driving the rotor 303 and waste power by the Joule loss of the drive coil DC resistances Rc and Rd. However, although the numbers of turns of the rotor-generated counter electromotive voltage detection coils 1504 and 1505 are as small as about 1/40 that of the drive coil 1502, the output from the adder 1308 has a level whose zero crossing point can be sufficiently detected by the zero crossing comparator 107 shown in FIG. 13 (to be described later). Therefore, the reactive power consumption of the rotor-generated counter electromotive voltage detection coils 1504 and 1505 is negligible when compared to the power consumption of the drive coil 1502.

Charts of FIGS. 26(*a*) to 26(*h*) of an embodiment for driving the rotor of the stepping motor having the cancel type coil at a high speed will be described with reference to the block diagram of a high-speed drive circuit of FIG. 25 for driving the rotor of the stepping motor having the cancel coil at a high speed. In this embodiment, an initial pulse generating means 113 generates a pulse constituted by an initial pulse E and an auxiliary initial pulse 201. An adder 1308 shown in FIG. 28 does not have R3C3, R4C4, and R5C5 low-pass filters shown in FIG. 30 (to be described later). A subsequent drive pulse generating means 114 has a function of masking the spike pulse generated by spike noise superposing on the counter electromotive voltage added by the adder, as has been described in detail with reference to the diagram of the circuit of FIG. 28 for masking the spike pulse in the digital manner. The subsequent drive pulse generating means 114 also has a function of calculating the rotational speed of the stepping motor from the pulse interval of the subsequent drive pulse H and decreasing the subsequent drive pulse width (the) as the rotational speed of the stepping motor is increased.

Operations prior to generation of the initial pulse E are the same as those of FIGS. 15(*a*) to 15(*e*) and a detailed description thereof will be omitted. An adder output F' of the adder 1308 connected to the counter electromotive voltage detection coils 1504 and 1505 is shown in FIG. 26(*f*). Spike noise 1402 is superposed on the adder output F'. Upon reception of the adder output F', the zero crossing comparator 107 outputs the zero crossing comparator output G to the subsequent drive pulse generating means 114, as shown in FIG. 26(*g*). A spike pulse 1404 corresponding to the spike noise 1402 is superposed on the zero crossing comparator output G. However, the subsequent drive pulse generating means 114 has a function of masking the spike pulse 1404 corresponding to the spike noise 1402 in the digital manner. Thus, after the subsequent drive pulse generating signal J, as shown in FIG. 18, is input from the initial pulse generating means 113, in response to a zero crossing point 1403 shown in FIG. 26(*f*), the subsequent drive pulse generating means 114 outputs the subsequent drive pulse H having a pulse width (the) smaller than the phase locking pulse width (tc) or the initial pulse width (te) corresponding to the battery voltage detected by the battery voltage detection circuit 111, as shown in FIG. 26(*h*), in synchronism with the rise time and fall time of the zero crossing comparator output G shown in FIG. 26(*g*) excluding the rise time and fall time of the spike pulse 1404.

The stepping motor 1501 is constantly accelerated by the subsequent drive pulse H and can rotate the rotor 303 at a high speed with a frequency matching the frictional resistance acting on the rotor 303. As the rotational speed of the stepping motor is increased, the subsequent drive pulse generating means 114 decreases the pulse width (the) of the subsequent drive pulse H and sets it to a pulse width (th) optimal as the rotational speed of the stepping motor. In this embodiment, since the adder 1308 does not have R3C3, R4C4, and R5C5 low-pass filters shown in FIG. 30 (to be described later), a time lag is not caused in the output F from the adder 1308 by these low-pass filters. Hence, a rotational angle θ corresponding to the rise and fall of the zero crossing comparator output is substantially $-\theta_0$ or $\pi-\theta_0$. When compared to an adder having a low-pass filter, the stepping motor can be sufficiently accelerated before rotation of its rotor is braked (braking is performed when θ=0 to π/2 or π to 3π/2) by the detent torque, thereby increasing the rotational speed of the rotor. In this embodiment, when the voltage applied to the driver of the stepping motor was 3 V and the pulse width of the subsequent drive pulse was about 3 ms, the rotational speed per minute of the rotor 303 was about 6,000 rpm, and the drive current (peak value) was as small as about 2 mA.

Figure 30:
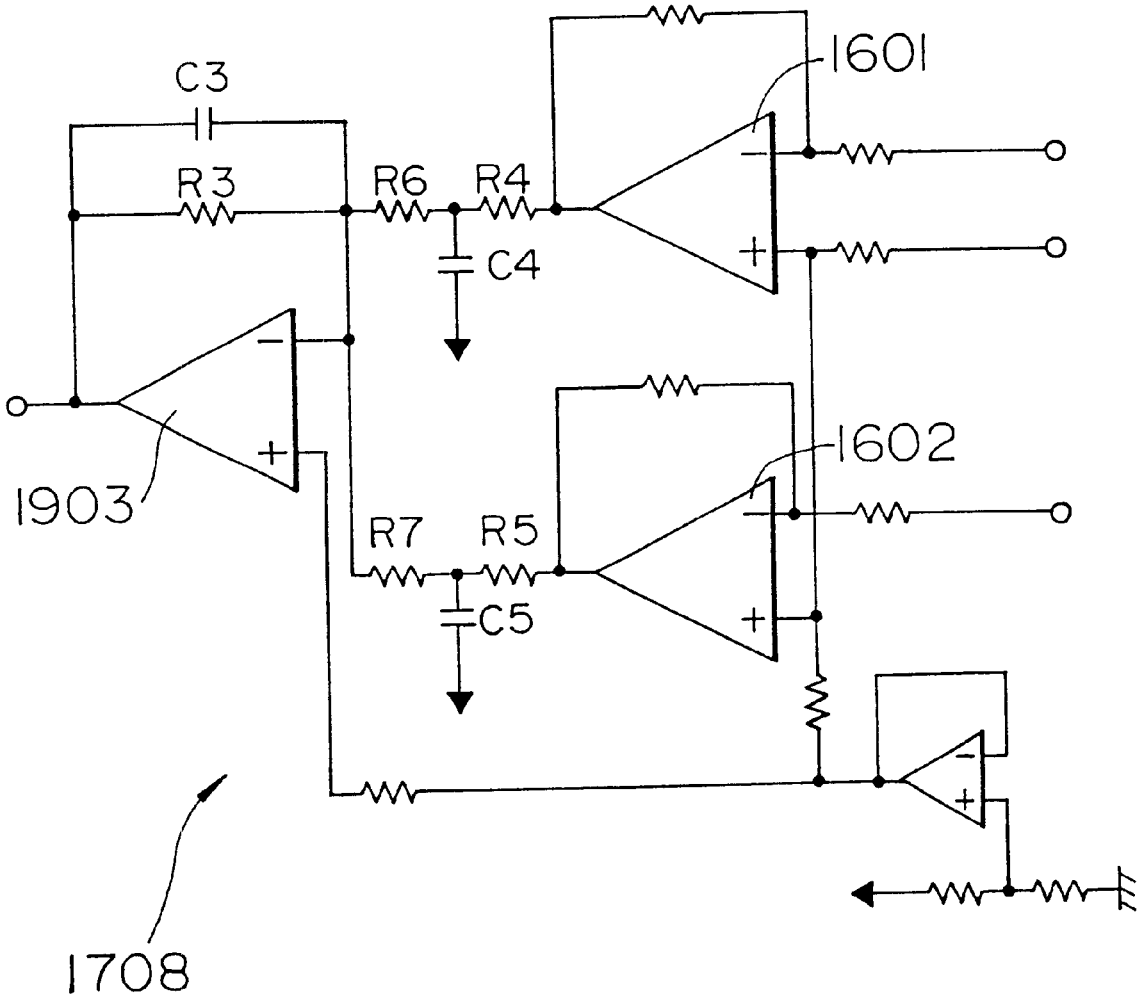
FIG. 30 is a circuit diagram of an adder having low-pass filters.

An embodiment wherein the circuit for masking the spike pulse in the digital manner is removed from the subsequent drive pulse generating means 114 and low-pass filters are connected to the adder will be described. Of FIGS. 29(*a*) to 29(*h*) showing an embodiment for driving the rotor of the stepping motor at a high speed, FIGS. 29(*a*) to 29(*e*) are the same as FIGS. 26(*a*) to 26(*e*), and a detailed description thereof will be omitted. FIG. 30 shows a circuit diagram of an adder 1708. The adder 1708 comprises differential amplifiers 1601 and 1602 respectively connected to the rotor-generated counter electromotive voltage detection coils 1504 and 1505, and an adder amplifier 1903 having R4C4 and R5C5 low-pass filters respectively connected to the output terminals of the differential amplifiers 1601 and 1602 and an R3C3 low-pass filter connected to the R4C4 and R5C5 low-pass filters and having an amplification factor of R3/R6 or R3/R7. The output of the adder 1708 is also expressed by equation (11) (the gain G includes frequency characteristics provided by the low-pass filters). However, since the outputs of the differential amplifiers 1601 and 1602 corresponding to the, generation timings of the subsequent drive pulses H have the same sign and cannot be removed by the adder amplifier 1903, they are superposed on the adder output F' as the spike noise. In this case, the spike noise means not only noise corresponding to the fall of the subsequent drive pulse H but also the noise corresponding to the entire subsequent drive pulse H from its rise to fall. If the adder output F' has azero crossing point at an arbitrary time due to the spike noise, an unnecessary subsequent drive pulse H is output from the drive pulse generating microcomputer 109, and the rotor 303 cannot rotate normally. Hence, the R4C4 and R5C5 low-pass filters and the R3C3 low-pass filter are required to remove the spike noise.

The cut-off frequency of the R3C3 low-pass filter can be obtained in accordance with the following equation (12):

$$f1=1/(2\pi\cdot R3\cdot C3) \tag{12}$$

The cut-off frequency of the R4C4 low-pass filter can be obtained in accordance with the following equation (13):

$$f2=1/(2\pi\cdot R4\cdot C4) \tag{13}$$

The cut-off frequency of the R5C5 low-pass filter can be obtained in accordance with the following equation (14):

$$f3=1/(2\pi\cdot R5\cdot C5) \tag{14}$$

In order to remove the spike noise, f1, f2, and f3 must be set within the range of fr to 4fr where fr is the maximum frequency of the stepping motor. Although these low-pass filters can remove, of the spike noise, the high-frequency spike noise corresponding to the rise and fall of the subsequent drive pulse H, they cannot remove the low-frequency spike noise lower than the cut-off frequencies f1, f2, and f3. Thus, a clamp 1802 occurs in the adder output F' shown in FIG. 29(*f*) within a time period in which the phase locking pulse C, the initial pulse E, and the subsequent drive pulse H are generated. However, the zero crossing output of the zero crossing comparator 107 caused by the spike pulse corresponding to the fall of the subsequent drive pulse H disappears, and the subsequent drive pulse H can be generated only by means of the zero crossing point of the rotor-generated counter electromotive voltage. Then, no problem arises in the stability of the high-speed rotation of the stepping motor.

Figure 31:
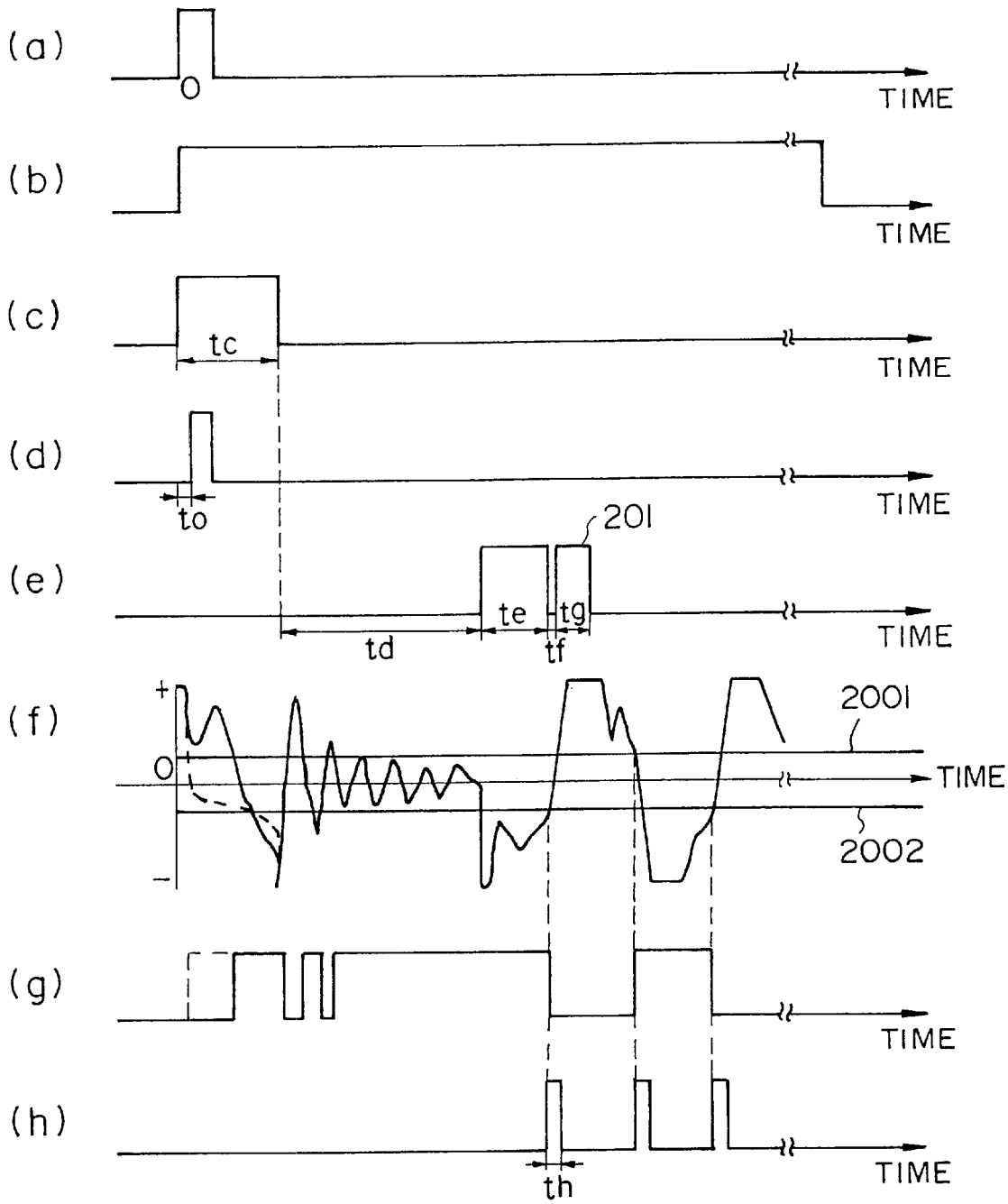
FIG. 31 shows charts of a case wherein a time lag in an adder output is to be canceled.

A time lag is caused in the adder output F by the low-pass filters, and the rotational angle θ corresponding to the rise and fall of the zero crossing comparator output G is shifted from $-\theta_0$ or $\pi-\theta_0$. In order to utilize the detent torque and the excitation torque generated by the drive current flowing in the drive coil 1502 effectively for driving the rotor 303 and to optimize the starting characteristics and frequency of the rotor 303, the rotational angle θ is preferably between a magnetic equilibrium point corresponding to the detent torque and an excitation equilibrium point corresponding to the excitation torque, and is preferably located between 0 and $-\theta_0$ or between $\pi-\theta_0$ and π, as shown in FIG. 16C. When the lag of the rotational angle θ becomes larger than $\theta_0$, as shown in FIG. 31(*f*) (FIGS. 31(*a*) to 31(*e*) are the same as FIGS. 29(*a*) to 29(*e*) and a detailed description thereof will thus be omitted), the zero crossing level of the zero crossing comparator 107 must be shifted from the zero level to the plus side (zero crossing level 2001) and to the minus side (zero crossing level 2002) in order to operate the zero crossing comparator 107 in the advanced direction along the time base, so that the rise and fall of the zero crossing comparator output G are advanced along the time axis, as shown in FIG. 31(*g*), and that generation of the subsequent drive pulse H is advanced along the time axis, as shown in FIG. 31(*h*), thereby compensating for the delay or lag of the rotational angle θ of the rotor 303.

Figure 32:
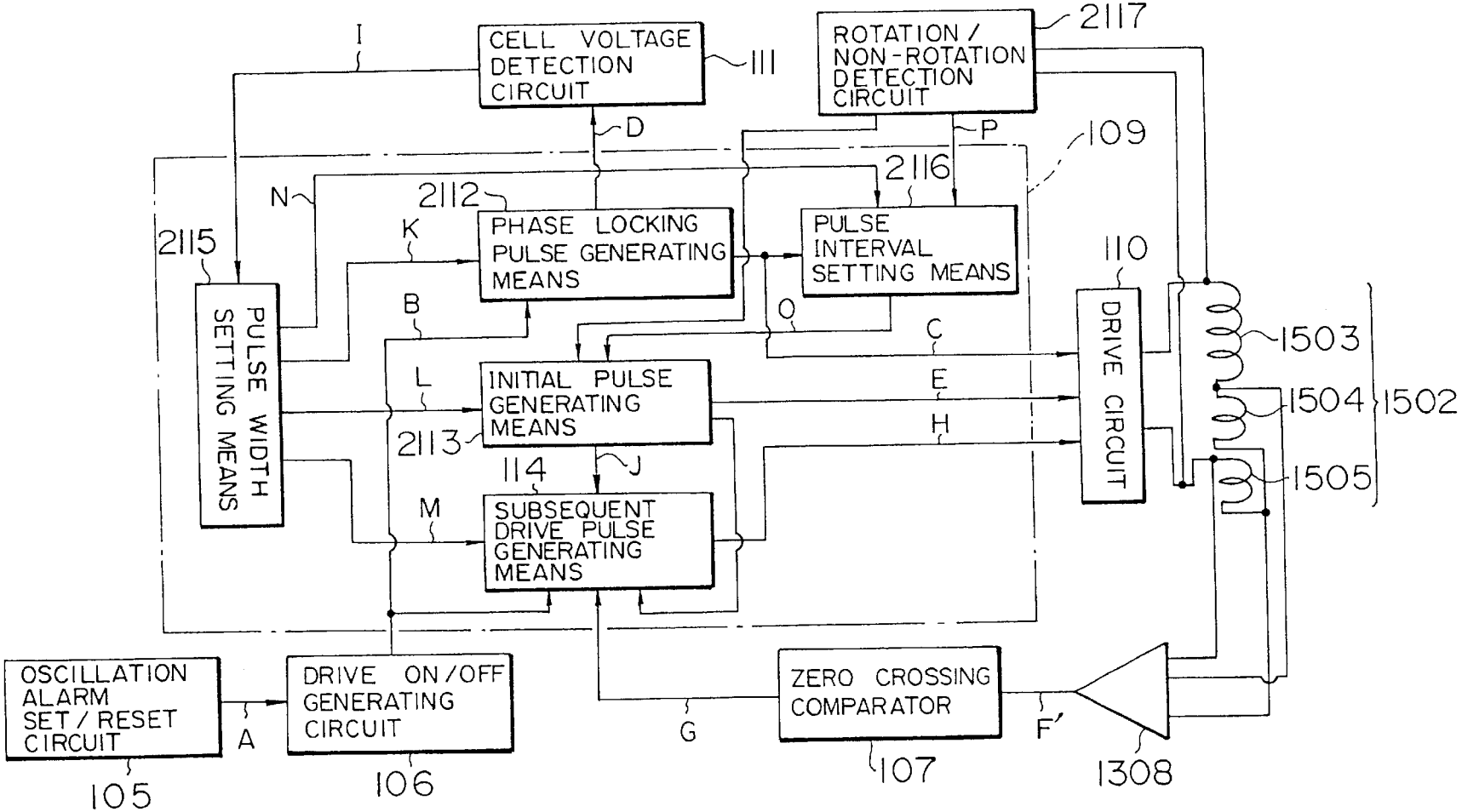
FIG. 32 is a block diagram of another embodiment of the high-speed drive circuit of the rotor of a stepping motor having a cancel coil, FIGS. 33(*a*) to 33(*h*) are charts of another example of a case wherein the rotor of the stepping motor having the cancel coil is rotated at a high speed.

A high-speed drive circuit for the rotor of the stepping motor having a cancel type coil according to another embodiment will be described with reference to the block diagram of FIG. 32. FIG. 32 is different from FIG. 25 in that a rotation/non-rotation detection circuit 2117 is added for detecting rotation/non-rotation of the rotor 303 driven by the phase locking pulse C and outputting a rotation/non-rotation signal to a pulse interval setting means 2116 and an initial pulse generating means 2113. Except for that, FIG. 32 has the same arrangement as that of FIG. 25, and a detailed description of the overlapping portion will thus be omitted.

Figure 33:
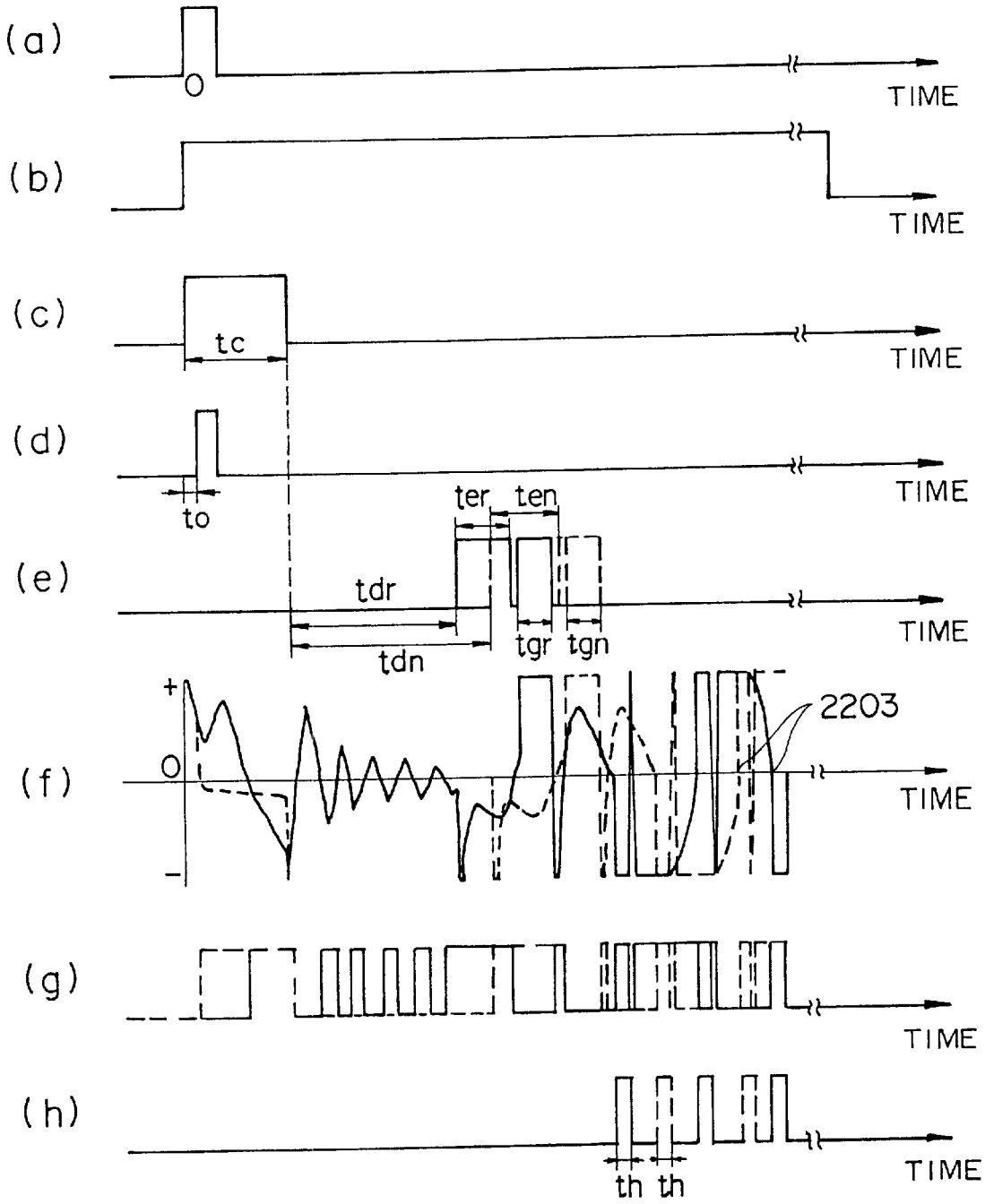

The charts of FIG. 33 of an embodiment for driving the rotor of the stepping motor having the cancel type coil at a high speed will be described with reference to the block diagram of FIG. 32 showing a high-speed drive circuit according to another embodiment for the rotor of the stepping motor having the cancel type coil. This embodiment is different from the embodiment described above in the following respects. Namely, upon reception of the initial pulse width signal L, in accordance with a battery voltage detected by a battery voltage detection circuit 111 and a rotation/non-rotation signal p from the rotation/non-rotation detection circuit 2117, the initial pulse generating means 2113 outputs, upon reception of an initial pulse generating signal 0, an initial pulse (having a pulse width ter during rotation of the rotor 303 and a pulse width ten during stop of the rotor 303) and an auxiliary initial pulse (having a pulse width tgr during rotation of the rotor 303 and a pulse width tgn during stop of the rotor 303) to a drive circuit 110 tdr (during rotation of the rotor 303) or tdn (during stop of the rotor 303) after the fall of the phase locking pulse C, as shown in FIG. 33(*e*) (in subsequent FIGS. 33(*f*), 33(*g*), and 33(*h*), a solid line indicates a case wherein the rotor 303 is rotated, and a broken line indicates a case wherein the rotor 303 is not rotated). In the high-speed drive circuit of this embodiment for the rotor of the stepping motor, since the rotation/non-rotation detection circuit 2117 is added to the high-speed rotor drive circuit of the above embodiment shown in FIG. 25 described above, the output time and the pulse width of the initial pulse E output from the initial pulse generating means 2113 can be set in accordance with not only the battery voltage detected by the battery voltage detection circuit 111 but also rotation/non-rotation of the rotor 303 driven by the phase locking pulse C. In order to detect rotation/non-rotation of the rotor 303 by the rotation/non-rotation detection circuit 2117, a predetermined period of time is required after the fall of the phase locking pulse C. Thus, even if the rotor 303 is rotated by the phase locking pulse C, the initial pulse E having a larger pulse width than that of the subsequent drive pulse H is required.

An adder output F' of the adder 1308 connected to the counter electromotive voltage detection coils 1504 and 1505 is shown in FIG. 33(*f*). Upon reception of the adder output F', a zero crossing comparator 107 outputs the zero crossing comparator output G to a subsequent drive pulse generating means 114, as shown in FIG. 33(*g*). Upon reception of a subsequent drive pulse width signal M, the subsequent drive pulse generating means 114 outputs a subsequent drive pulse having a pulse width (th) smaller than the phase locking pulse width (tc) or the initial pulse width (ter, ten) corresponding to the battery voltage detected by the battery voltage detection circuit 111, as shown in FIG. 33(*h*), in synchronism with the rise time and fall time of the zero crossing comparator output G corresponding to the zero crossing points 2203 shown in FIG. 33(*f*). A stepping motor 1501 is constantly accelerated by the subsequent drive pulse H and can rotate the rotor 303 at a high speed with a rotational speed matching the frictional resistance acting on the rotor 303.

Figure 34:
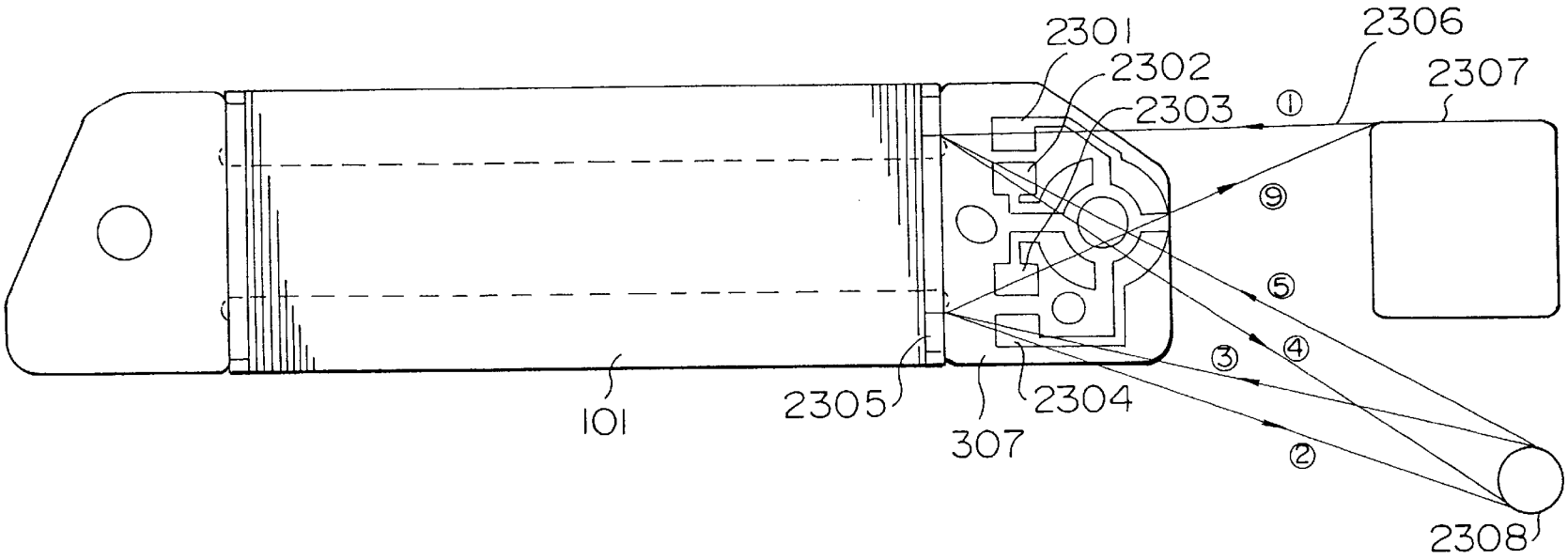
FIG. 34 is a view for explaining a method of winding a drive coil having a cancel coil.

A method of winding a drive coil in a cancel type coil shown in FIG. 34 will be described. A drive coil 1502 comprising an effective drive coil 1503 and rotor-generated counter electromotive voltage detection coils 1504 and 1505 is pulled by a wire 2306 shown in FIG. 34 from a wire guide 2307 by way of ①. The wire 2306 is hitched to a coil frame 2305. The rotor-generated counter electromotive voltage detection coil 1505 is wound on a coil core 307. The wire 2306 is hitched to a wire catching pin 2308 by way of ② and then to the coil frame 2305 by way of ③. The rotor-generated counter electromotive voltage detection coil 1504 is wound on the coil core 307 in the opposite direction to that of the rotor-generated counter electromotive voltage detection coil 1505. The wire 2306 is hitched to the wire catching pin 2308 by way of ④ and then to the coil frame 2305 by way of ⑤. The effective drive coil 1503 is wound on the coil core 307 in the opposite direction to that of the rotor-generated counter electromotive voltage detection coil 1505, and the wire 2306 is hitched to the wire guide 2307 by way of ⑥. The two coil terminals of the rotor-generated counter electromotive voltage detection coil 1505 are respectively brought into tight contact with coil terminals 1, 2301 and 4, 2304. The two coil terminals of the rotor-generated counter electromotive voltage detection coil 1504 are respectively brought into tight contact with coil terminals 2, 2302, and 4, 2304. The two coil terminals of the effective drive coil 1503 are respectively brought into tight contact with coil terminals 2, 2302 and 3, 2303. The wire 2306 unnecessary for the drive coil 1502 is cut, thereby completing automatic winding of the drive coil 1502 on the coil core 307.

Figure 35:
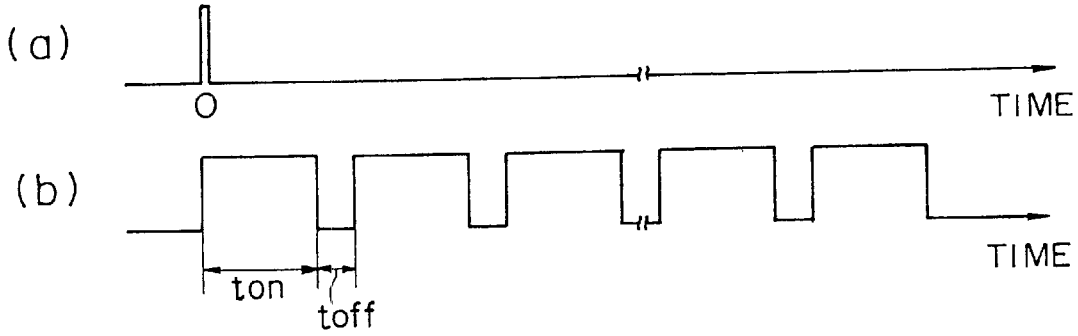
FIG. 35 shows the first example of vibration modulation of the vibration alarm.

Vibration modulation of the vibration alarm of the first example shown in FIG. 35 will be described. Upon reception of a vibration alarm generating pulse A shown in FIG. 35(*a*) from the vibration alarm set/reset circuit 105, the drive ON/OFF generating circuit 106 in FIGS. 14, 21, 25, 29, and 32 outputs a drive ON/OFF signal B comprising a pulse train of drive ON time ton corresponding to drive ON of the stepping motor and drive OFF time toff corresponding to drive OFF. The stepping motor is driven within the drive ON time ton and stopped within the drive OFF time toff by the drive ON/OFF signal B. Thus, the vibration of the vibration alarm is modulated, and the vibration of the eccentric weight of the stepping motor can be transmitted to the sense organ of the arm through the watch case more intensely than a constant vibration having no modulation.

Figure 36:
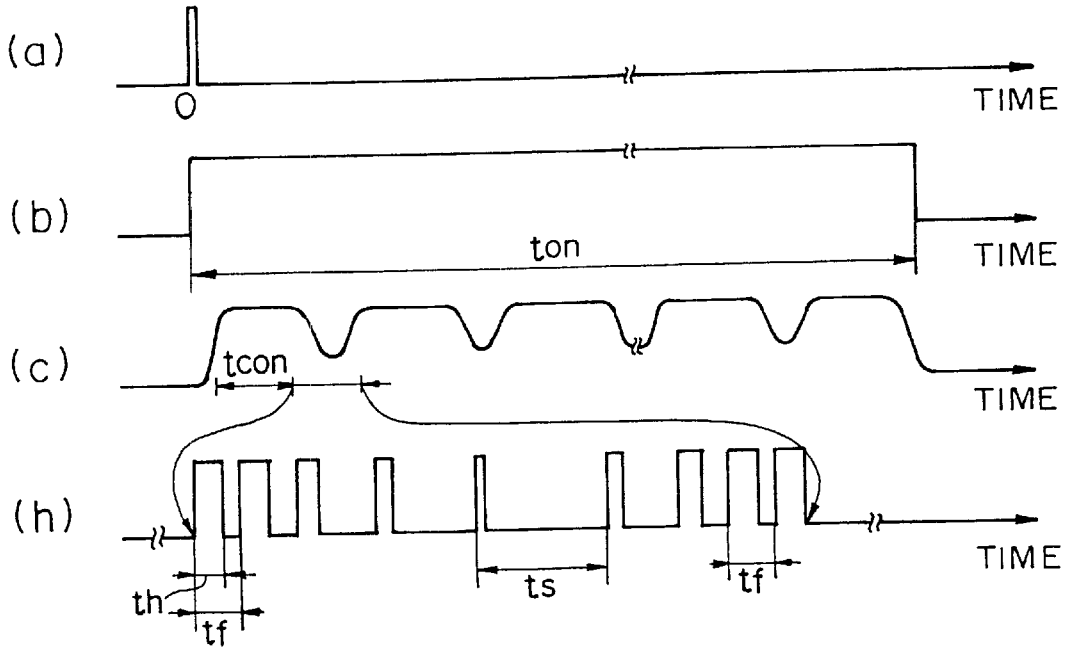
FIG. 36 shows the second example of vibration modulation of the vibration alarm.

Vibration modulation of the vibration alarm of the second example shown in FIG. 36 will be described. Upon reception of a vibration alarm generating pulse A shown in FIG. 36(*a*) from the vibration alarm set/reset circuit 105, the drive ON/OFF generating circuit 106 in FIGS. 14, 21, 25, 29, and 32 outputs a drive ON/OFF signal B comprising a pulse of drive ON time ton corresponding to drive ON of the stepping motor. As shown in FIG. 36(*c*), the subsequent drive pulse generating means generates a subsequent drive pulse having a predetermined pulse width (th) during a time tcon. Thereafter, the subsequent drive pulse interval is measured while the subsequent drive pulse width is gradually decreased. When the subsequent drive pulse interval becomes ts, the subsequent drive pulse width is gradually increased. When the subsequent drive pulse interval becomes tf, the subsequent drive pulse generating means generates a pulse having a predetermined pulse width (th) during a time tcon. This operation is repeated. The rotational speed of the stepping motor is increased and decreased by this repeated operation. Thus, vibration of the vibration alarm is modulated, and the vibration of the eccentric weight of the stepping motor can be transmitted to the sense organ of the arm through the watch case more intensely than constant vibration having no modulation.

A calculation result of the rpm of the rotor obtained by theoretical simulation will be described. The rotor is driven by the optimum drive method wherein the position of the rotor is detected from the counter electromotive voltage (to be referred to as rotor-generated electromotive voltage hereinafter) induced in the drive coil by the magnetic flux generated by a rotating rotor, a drive current is supplied to the drive coil in synchronism with the time when the position of the rotor is detected, and the rotor is accelerated.

The rotational angle θ of the rotor can be obtained in accordance with equation (15). As shown in the plan view of the stator and the rotor of FIG. 16C, the clockwise rotational angle θ of the rotor with respect to the magnetic equilibrium point of θ=0 of FIG. 16C is a positive angle.

$$J\cdot(d^2\theta/dt^2)+r\cdot(d\theta/dt)=K\cdot i\cdot\sin(\theta+\theta_0)-Ts\cdot\sin 2\theta-T_L-Mg\cdot\cos\theta \qquad (15)$$

The drive current i is obtained in accordance with equation (16):

$$L\cdot(di/dt)+K\cdot\sin(\theta+\theta_0)\cdot(d\theta/dt)+R\cdot i=(u(t)-u(t-\tau))\cdot V-R_0(i,V)\cdot i \qquad (16)$$

Note that J is the moment of inertia of the rotor, r is the fluid resistance coefficient of the rotor, K is the electromechanical coupling coefficient, $\theta_0$ is the initial angle of the rotor, Ts is the maximum value of the detent torque, $T_L$ is the load torque, Mg is the maximum gravitational moment of the eccentric weight, L is the self-inductance of the drive coil, R is the drive coil DC resistance of the drive coil, u(t) is the unit function of the time t, τ is the drive pulse width, V is the voltage applied to the motor driver, and $R_0$(i, V) is the ON resistance of the motor driver.

Figure 37:
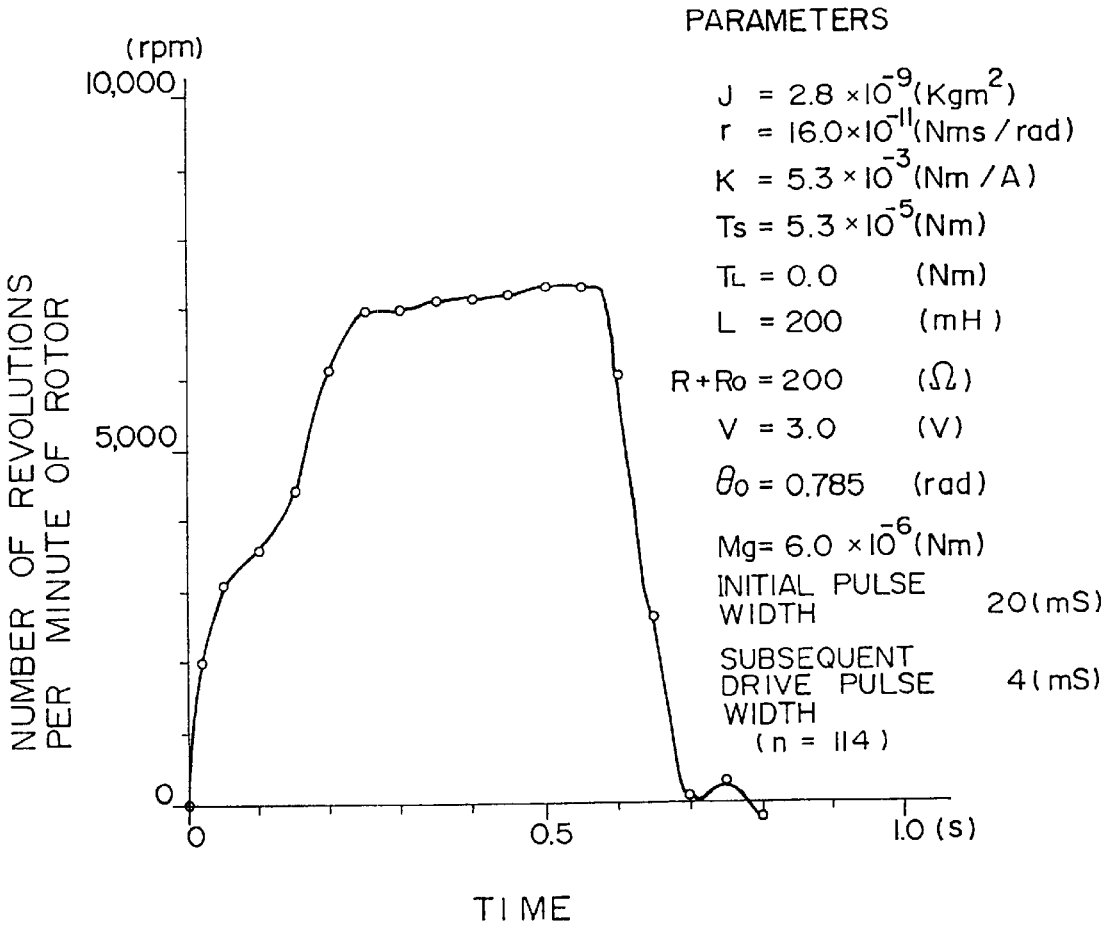
FIG. 37 shows the result of simulation calculation of a change in rotational speed of a stepping motor over time.

FIG. 37 shows the calculation result (change in rpm of the rotor over time) of the simulation obtained by accelerating the rotor by a subsequent drive pulse (pulse width τ) with the rotational angle θ ($-\theta_0$, $-\theta_0+\pi$) or at a time that provides the rotor-generated counter electromotive voltage $-K\cdot\sin(\theta+\theta_0)\cdot(d\theta/dt)=0$ where the initial angle of the rotor is $\theta_0$ ($\pi/4=0.785$ rad). Regarding the respective parameters, as shown in FIG. 37, the voltage to be applied is 3.0 (V), the drive coil DC resistance ($R+R_0$) including the ON resistance of the motor driver is 200 (Ω), the self-inductance L is 200 mH, the inertia moment J is $2.8\times10^{-9}$ ($kgm^2$), the fluid resistance coefficient τ is $16.0\times10^{-11}$ (Nms/rad), the electromechanical coupling coefficient K is $5.3\times10^{-3}$ (Nm/A), the detent torque Ts is $5.3\times10^{-5}$ (Nm), the load torque $T_L$ is 0.0 (Nm), and the moment Mg caused by the gravity of the eccentric weight is $6.0\times10^{-6}$ (Nm). Where the angular position θ of the initial stop of the rotor of $-\sin^{-1}$ (Mg/2Ts) was about −0.06 rad, the initial angular velocity (dθ/dt) of the rotor was 0 rad/s, and the initial-stage drive current i was 0 mA, in the change in rpm of the rotor over time with the initial pulse width of 20 ms and 114 subsequent drive pulses having a pulse width τ of 4 ms, the maximum rotational speed was 7,000 rpm, and the rotor stop time after the subsequent drive pulse was ended (about 0.55 s) was about 0.15 s. The drive current was 15 mA at starting and about 3 mA during constant high-speed rotation about 0.5 s after starting. From this simulation calculation of the rotational speed of the rotor, it was known that the frequency of the rotor became 3,000 rpm or more in accordance with a method wherein the position of the rotor was detected from the rotor-generated counter electromotive voltage, a drive current is supplied to the drive coil in synchronism with the time when the position of the rotor was detected, and the rotor was accelerated. It was also known that the drive current (peak value) during constant high-speed rotation can be decreased to about 3 mA.

Figure 38A:
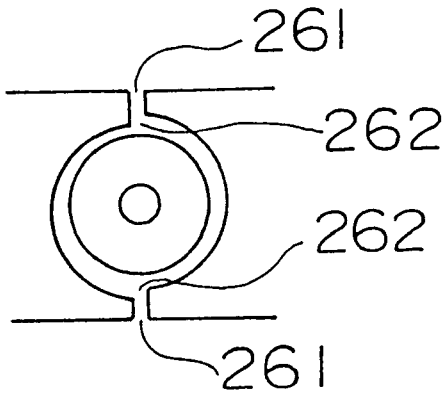
FIGS. 38A to 38D are plan views respectively showing practical examples of flat bipolar stators that can be used in the present invention.
Figure 38B:
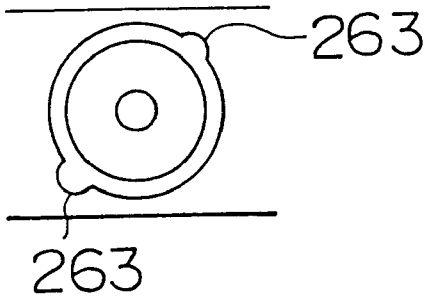
Figure 38C:
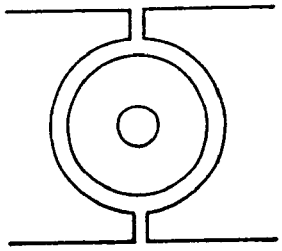
Figure 38D:
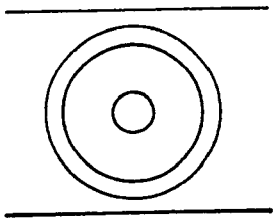

A stator that can be used in the present invention will be described. The above embodiments have been described by using a flat bipolar stator shown in FIG. 38A having slits 261 and steps 262. However, the present invention is not limited to this, and can also be realized by using a flat bipolar stator shown in FIG. 38B having no step but having notches 263, a flat bipolar stator shown in FIG. 38C having only slits and no step, and a flat bipolar stator shown in FIG. 38D having no slit and step. In the case of the flat bipolar stator of FIG. 38D, it can be driven by preparing a plurality of initial pulses having different pulse widths and selectively outputting an optimum initial pulse.

What is claimed is:

1. Electronic equipment, comprising:

a motor comprising a flat bipolar stator provided with a rotor housing having a shape generating a holding torque, a rotor including a bipolar permanent magnet and a drive coil magnetically coupled to said flat bipolar stator, in which a magnetomotive power generated in said drive coil is transferred to said rotor, drive pulse generating means for outputting a drive pulse for driving said motor;

a drive circuit for supplying a drive current to said drive coil on the basis of the drive pulse from said pulse generating means;

a counter electromotive voltage detection coil for detecting a counter electromotive voltage generated by rotation of said rotor; and magnetic pole position detection means for detecting a magnetic pole position of said rotor, which is rotating, with respect to said flat bipolar stator on the basis of the counter electromotive voltage generated in said counter electromotive voltage detection coil, and further in order to accelerate rotation speed of said rotor, said magnetic pole position detection means being allowed to output, to said drive pulse generating means, a detection signal for controlling an output timing of the drive pulse at a magnetic pole position of said rotor where the counter electromotive voltage becomes substantially zero when said rotor is rotating, and where the magnetic pole position of said rotor is different from a magnetic equilibrium point corresponding to the holding torque when said rotor is not rotating.

2. Electronic equipment according to claim 1, wherein said magnetic pole position detection means has a zero crossing comparator for outputting a detection signal upon detecting the fact that the counter electromotive voltage generated in said counter electromotive voltage detection coil reaches a zero level.

3. Electronic equipment according to claim 1, wherein said magnetic pole position detection means has a zero crossing comparator for outputting a detection signal upon detecting the fact that the counter electromotive voltage generated in said counter electromotive voltage detection coil reaches a zero level.

4. Electronic equipment according to claim 1, wherein the drive signal outputted from said drive pulse generating means is a pulse signal, the pulse signal comprising a starting pulse for starting rotation of said rotor which is in stationary condition, and a subsequent drive pulse for continuously driving said rotor after it has commenced rotation.

5. Electronic equipment according to claim 1, wherein the drive signal outputted from said drive pulse generating means is a pulse signal, the pulse signal comprising a starting pulse for starting rotation of said rotor being in stationary condition, and a subsequent drive pulse for continuously driving said rotor after it has commenced rotation.

6. Electronic equipment according to claim 4, wherein the starting pulse for starting rotation of said rotor being in stationary condition comprises a phase locking pulse for allowing magnetic poles of said rotor opposing magnetic poles generated in said flat stator to have the same polarity as that of said magnetic poles of said flat stator, and an initial pulse, outputted after the phase locking pulse, for causing said flat stator opposing said magnetic poles of said rotor to generate magnetic poles having the same polarity as that of said magnetic poles of said rotor magnet.

7. Electronic equipment according to claim 5, wherein the starting pulse for starting rotation of said rotor being in stationary condition comprises a phase locking pulse for allowing magnetic poles of said rotor opposing magnetic poles generated in said flat stator to have the same polarity as that of said magnetic poles of said flat stator, and an initial pulse, outputted after the phase locking pulse, for causing said flat stator opposing said magnetic poles of said rotor to generate magnetic poles having the same polarity as that of said magnetic poles of said rotor magnet.

8. Electronic equipment according to claim 6, wherein the initial pulse has a pulse width larger than that of the subsequent drive pulse.

9. Electronic equipment according to claim 7, wherein the initial pulse has a pulse width larger than that of the subsequent drive pulse.

10. Electronic equipment according to claim 8, wherein the initial pulse is a pulse train of a plurality of pulses each having a pulse width larger than that of the subsequent drive pulse.

11. Electronic equipment according to claim 9, wherein the initial pulse is a pulse train of a plurality of pulses each having a pulse width larger than that of the subsequent drive pulse.

12. Electronic equipment according to claim 10, wherein the pulse train of the plurality of pulses comprises a first initial pulse having a pulse width larger than that of the subsequent drive pulse, and a second initial pulse having a pulse width smaller than that of the first initial pulse.

13. Electronic equipment according to claim 11, wherein the pulse train of the plurality of pulses comprises a first initial pulse having a pulse width larger than that of the subsequent drive pulse, and a second initial pulse having a pulse width smaller than that of the first initial pulse.

14. Electronic equipment according to claim 4, wherein the pulse width of the subsequent drive pulse is narrowed as a rotational speed of said rotor is increased.

15. Electronic equipment according to claim 5, wherein the pulse width of the subsequent drive pulse is narrowed as a rotational speed of said rotor is increased.

16. Electronic equipment according to claim 1, wherein said counter electromotive voltage detection coil is wound independently inside said drive coil.

17. Electronic equipment according to claim 1, wherein said counter electromotive voltage detection coil is wound independently inside said drive coil.

18. Electronic equipment according to claim 1, wherein said drive coil serves also as said counter electromotive voltage detection coil.

19. Electronic equipment according to claim 1, wherein said drive coil serves also as said counter electromotive voltage detection coil.

20. Electronic equipment according to claim 18, wherein a part of said drive coil serves also as said counter electromotive voltage detection coil by separating a tap from said part of said drive coil.

21. Electronic equipment according to claim 19, wherein a part of said drive coil serves also as said counter electromotive voltage detection coil by separating a tap from said part of said drive coil.

22. Electronic equipment according to claim 16, wherein said magnetic pole position detection means comprises a differential amplifier for differentially amplifying the counter electromotive voltage generated in said counter electromotive voltage detection coil, and a zero crossing comparator for outputting a detection signal upon detecting the fact that the counter electromotive voltage differentially amplified by said differential amplifier reaches zero.

23. Electronic equipment according to claim 11, wherein said magnetic pole position detection means comprises a differential amplifier for differentially amplifying the counter electromotive voltage generated in said counter electromotive voltage detection coil, and a zero crossing comparator for outputting a detection signal upon detecting the fact that the counter electromotive voltage differentially amplified by said differential amplifier reaches zero.

24. Electronic equipment according to claim 18, wherein said magnetic pole position detection means comprises a differential amplifier for differentially amplifying the counter electromotive voltage generated in said counter electromotive voltage detection coil, and a zero crossing comparator for outputting a detection signal upon detecting the fact that the counter electromotive voltage differentially amplified by said differential amplifier reaches zero.

25. Electronic equipment according to claim 19, wherein said magnetic pole position detection means comprises a differential amplifier for differentially amplifying the counter electromotive voltage generated in said counter electromotive voltage detection coil, and a zero crossing comparator for outputting a detection signal upon detecting the fact that the counter electromotive voltage differentially amplified by said differential amplifier reaches zero.

26. Electronic equipment according to claim 1, wherein said counter electromotive voltage detection coil comprises first and second counter electromotive voltage detection coils which have substantially the same DC resistance and self-inductance as each other and different directions of winding to each other and are connected in series to said drive coil.

27. Electronic equipment according to claim 1, wherein said counter electromotive voltage detection coil comprises first and second counter electromotive voltage detection coils which have substantially the same DC resistance and self-inductance as each other and different directions of winding to each other and are connected in series to said drive coil.

28. Electronic equipment according to claim 26, wherein said magnetic pole position detection means comprises an adder for adding counter electromotive voltages generated in said first and second counter electromotive voltage detection coils, and a zero crossing comparator for outputting the detection signal upon detecting the fact that a counter electromotive voltage added by said adder reaches zero.

29. Electronic equipment according to claim 27, wherein said magnetic pole position detection means comprises an adder for adding counter electromotive voltages generated in said first and second counter electromotive voltage detection coils, and a zero crossing comparator for outputting the detection signal upon detecting the fact that a counter electromotive voltage added by said adder reaches zero.

30. Electronic equipment according to claim 26, wherein said counter electromotive voltage detection coil is wound in a multi-layer manner inside said drive coil.

31. Electronic equipment according to claim 27, wherein said counter electromotive voltage detection coil is wound in a multi-layer manner inside said drive coil.

32. Electronic equipment according to claim 28, wherein said counter electromotive voltage detection coil is wound in a multi-layer manner inside said drive coil.

33. Electronic equipment according to claim 29, wherein said counter electromotive voltage detection coil is wound in a multi-layer manner inside said drive coil.

34. Electronic equipment according to claim 28, wherein said adder has a low-pass filter for cutting spike noise superposed on the counter electromotive voltage.

35. Electronic equipment according to claim 29, wherein said adder has a low-pass filter for cutting spike noise superposed on the counter electromotive voltage.

36. Electronic equipment according to claim 28, wherein said drive pulse generating means has mask means for digitally masking the detection signal from said zero crossing comparator in response to spike noise superposed on the counter electromotive voltage added by said adder.

37. Electronic equipment according to claim 29, wherein said drive pulse generating means has mask means for digitally masking the detection signal from said zero crossing comparator in response to spike noise superposed on the counter electromotive voltage added by said adder.

38. Electronic equipment according to claim 22, wherein said differential amplifier has a low-pass filter for cutting spike noise superposed on the differentially amplified counter electromotive voltage.

39. Electronic equipment according to claim 23, wherein said differential amplifier has a low-pass filter for cutting spike noise Superposed on the differentially amplified counter electromotive voltage.

40. Electronic equipment according to claim 24, wherein said differential amplifier has a low-pass filter for cutting spike noise superposed on the differentially amplified counter electromotive voltage.

41. Electronic equipment according to claim 25, wherein said differential amplifier has a low-pass filter for cutting spike noise superposed on the differentially amplified counter electromotive voltage.

42. Electronic equipment according to claim 22, wherein said drive pulse generating means has mask means for digitally masking the detection signal from said zero crossing comparator in response to spike noise superposed on the counter electromotive voltage differentially amplified by said differential amplifier.

43. Electronic equipment according to claim 23, wherein said drive pulse generating means has mask means for digitally masking the detection signal from said zero crossing comparator in response to spike noise superposed on the counter electromotive voltage differentially amplified by said differential amplifier.

44. Electronic equipment according to claim 24, wherein said drive pulse generating means has mask means for digitally masking the detection signal from said zero crossing comparator in response to spike noise superposed on the counter electromotive voltage differentially amplified by said differential amplifier.

45. Electronic equipment according to claim 25, wherein said drive pulse generating means has mask means for digitally masking the detection signal from said zero crossing comparator in response to spike noise superposed on the counter electromotive voltage differentially amplified by said differential amplifier.

46. Electronic equipment according to claim 1, wherein said magnetic pole position detection means can detect a magnetic pole position of said rotor during rotation on the basis of the counter electromotive voltage generated in said counter electromotive voltage detection coil.

47. Electronic equipment according to claim 1, wherein said magnetic pole position detection means can detect a magnetic pole position of said rotor during rotation on the basis of the counter electromotive voltage generated in said counter electromotive voltage detection coil.

48. Electronic equipment according to claim 2, wherein said magnetic pole position detection means can detect a counter electromotive voltage in the neighborhood of and before or after a zero level by setting a zero crossing level of said zero crossing comparator, which being provided in said magnetic pole position detection means, to a predetermined level shifted from the zero level.

49. Electronic equipment according to claim 3, wherein said magnetic pole position detection means can detect a counter electromotive voltage in the neighborhood of and before or after a zero level by setting a zero crossing level of said zero crossing comparator, which being provided in said magnetic pole position detection means, to a predetermined level shifted from the zero level.

50. Electronic equipment according to claim 1, wherein said bipolar flat stator is one selected from the group consisting of a slit type stator and one piece type stator without having a slit.

51. Electronic equipment according to claim 1, further comprising:

a battery for supplying electric power to said drive circuit;

a battery voltage detection circuit for detecting a voltage of said battery; and a pulse width setting means for setting an optimum pulse width of the drive pulse in response to an output signal from said battery voltage detection circuit.

52. Electronic equipment according to claim 1, further comprising:

a battery for supplying an electric power to said drive circuit;

a battery voltage detection circuit for detecting a voltage of said battery; and a pulse width setting means for setting an optimum pulse width of the drive pulse in response to an output signal from said battery voltage detection circuit.

53. Electronic equipment according to claim 1, wherein said rotor has an eccentric weight mounted on a rotary shaft of said rotor so as to generate vibration when said rotor rotates.

54. Electronic equipment according to claim 1, wherein said rotor has an eccentric weight mounted on a rotary shaft of said rotor so as to generate vibration when said rotor rotates.

* * * * *